US009696670B2

(12) United States Patent
Abe et al.

(10) Patent No.: US 9,696,670 B2
(45) Date of Patent: Jul. 4, 2017

(54) FIXING DEVICE WITH RECORDING MEDIUM TEMPERATURE CONTROL

(71) Applicant: FUJI XEROX CO., LTD., Tokyo (JP)

(72) Inventors: Masaaki Abe, Minamiashigara (JP); Nobuhiro Katsuta, Ashigarakami-gun (JP); Yasufumi Suwabe, Minamiashigara (JP); Satoshi Tatsuura, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/196,527

(22) Filed: Jun. 29, 2016

(65) Prior Publication Data

US 2017/0060055 A1 Mar. 2, 2017

(30) Foreign Application Priority Data

Aug. 25, 2015 (JP) ..... 2015-166035
Mar. 16, 2016 (JP) ..... 2016-052547

(51) Int. Cl.
*G03G 15/20* (2006.01)

(52) U.S. Cl.
CPC ..... *G03G 15/2053* (2013.01); *G03G 15/2021* (2013.01); *G03G 15/2039* (2013.01)

(58) Field of Classification Search
CPC ..... G03G 15/2064; G03G 15/2053; G03G 2215/2019
USPC ..... 399/329
See application file for complete search history.

(56) References Cited

U.S. PATENT DOCUMENTS 8,265,536 B2 * 9/2012 Condello ..... G03G 15/2021 399/328
2007/0082301 A1 * 4/2007 Oyamada ..... G03C 1/49872 430/348
2012/0039643 A1 * 2/2012 Chang ..... G03G 15/2007 399/320
2015/0268599 A1 * 9/2015 Tatsuura ..... G03G 15/11 399/320
2015/0268613 A1 * 9/2015 Komatsuzaki ..... G03G 15/238 399/341

FOREIGN PATENT DOCUMENTS

JP 2006-051804 A 2/2006
JP 2015-001560 A 1/2015

* cited by examiner

*Primary Examiner* — Susan Lee
(74) *Attorney, Agent, or Firm* — Oliff PLC

(57) ABSTRACT

A fixing device includes a fixing unit that fixes a developer on a recording medium, a first heating unit, and at least one second heating unit. The first heating unit is disposed at an upstream side of the fixing unit in a transport direction of the recording medium, and heats the recording medium so that a temperature of the recording medium is set at a first temperature that is equal to or lower than a temperature of the fixing member and is equal to or higher than a thermal deformation temperature at which the recording medium is deformed. The at least one second heating unit comes into contact with the recording medium at a downstream side with respect to the first heating unit and at an upstream side with respect to the fixing unit, and heats the recording medium at a second temperature that is lower than the first temperature.

9 Claims, 22 Drawing Sheets

FIG. 6

| HEATING TEMPERATURE [°C] | FILM A | FILM B |
|---|---|---|
| 70 | 0.4 | 0.5 |
| 80 | 0.3 | 0.5 |
| 90 | 0.3 | 0.3 |
| 100 | 0.3 | 0.25 |
| 110 | 0.3 | 0.25 |
| 120 | 0.3 | 0.25 |
| 130 | 0.3 | 0.25 |

FIG. 15
| | FILM A | FILM B | FILM C |
|---|---|---|---|
| APPARATUS A | 1.5 | 2 | 1.5 |
| APPARATUS B | 1.5 | 2 | 1.5 |
| APPARATUS C | 2.5 | 2.5 | 2 |
FIG. 16A
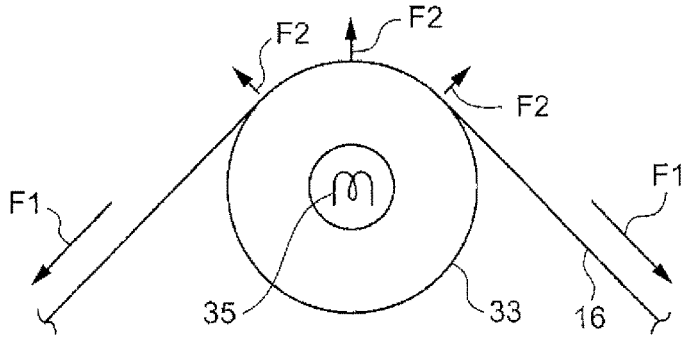
FIG. 16B
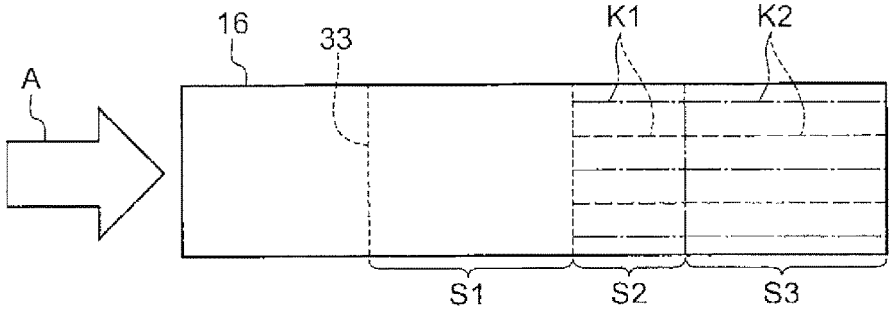

FIXING DEVICE WITH RECORDING MEDIUM TEMPERATURE CONTROL

CROSS-REFERENCE TO RELATED APPLICATIONS

This application is based on and claims priority under USC 119 from Japanese Patent Application No. 2015-166035, filed on Aug. 25, 2015 and Japanese Patent Application No. 2016-052547, filed on Mar. 16, 2016.

BACKGROUND

Technical Field

The present invention relates to a fixing device and an image forming apparatus.

SUMMARY

According to an aspect of the invention, there is provided a fixing device including: a fixing unit that comprises a fixing member heating a developer on a thermoplastic recording medium that is transported in a state where a tensile force is applied to the recording medium, and fixes the heated developer on the recording medium; a first heating unit that is disposed at an upstream side with respect to the fixing unit in a transport direction of the recording medium, and heats the recording medium so that a temperature of the recording medium is set at a first temperature that is equal to or lower than a temperature of the fixing member and is equal to or higher than a thermal deformation temperature at which the recording medium is deformed; and at least one second heating unit that comes into contact with the recording medium at a downstream side with respect to the first heating unit and at an upstream side with respect to the fixing unit, and heats the recording medium at a second temperature that is lower than the first temperature.

BRIEF DESCRIPTION OF DRAWINGS

Exemplary embodiments of the present invention will be described in detail based on the following figures, wherein:

FIG. 6 is a table showing thermal deformation times at heating temperatures of a film A and a film B according to the first exemplary embodiment;

FIG. 15 is a table showing an evaluation rank of a vertical stripe when films A, B, and C are used for the image forming apparatuses according to the first, second, and third exemplary embodiments;

FIG. 16A is a diagram showing a force acting on a film when the film is heated by a heating roller according to a comparative example, and FIG. 16B is a diagram showing a state where a vertical stripe occurs on a film when the film is heated using the heating roller according to the comparative example;

DETAILED DESCRIPTION

First Exemplary Embodiment

Examples of a fixing device and an image forming apparatus according to a first exemplary embodiment will now be described with reference to the accompanying drawings.

Figure 1:
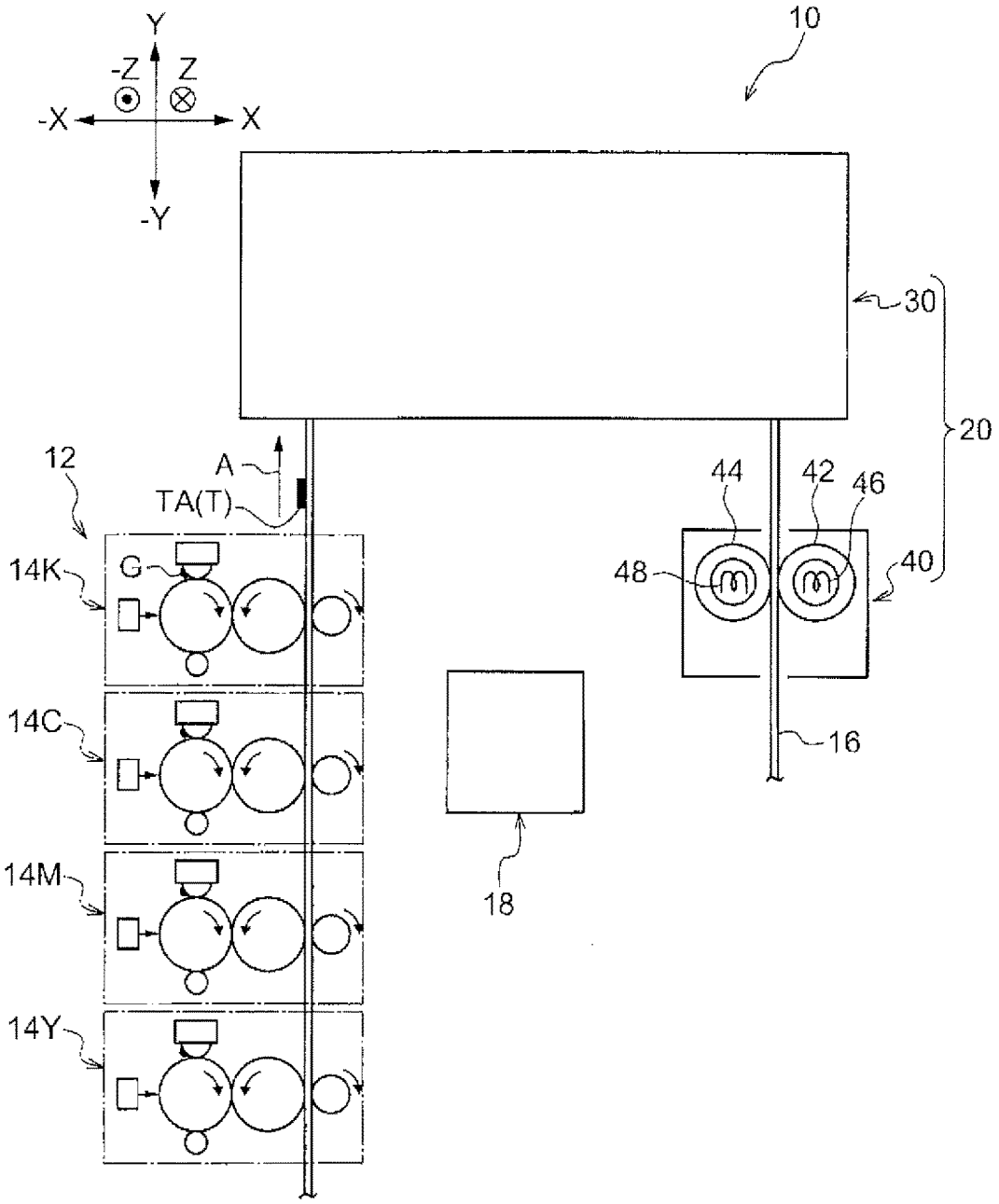
FIG. 1 is a diagram showing the overall configuration of an image forming apparatus according to a first exemplary embodiment.

In the following description, a direction indicated by an arrow Y in FIG. 1 is set to be an apparatus height direction, and a direction indicated by an arrow X in FIG. 1 is set to be an apparatus width direction. In addition, a direction (indicated by Z) that is perpendicular to the apparatus height direction and the apparatus width direction is set to be an apparatus depth direction. In addition, the apparatus height direction, the apparatus width direction, and the apparatus depth direction will be referred to as a Y-direction, an X-direction, and a Z-direction, respectively, when an image forming apparatus 10 is seen from a side where a user (not shown) stands (when seen from the front). Further, when it is necessary to distinguish between one side and the other side of each of the X-direction, the Y-direction, and the Z-direction, an upper side, a lower side, a right side, a left side, a back side, and a front side will be referred to as a Y side, a −Y side, an X side, a −X side, a Z side, and a −Z side, respectively, when the image forming apparatus 10 is seen from the front.

Overall Configuration

As shown in FIG. 1, the image forming apparatus 10 includes an image forming unit 12 as an example of a developer image forming unit, a fixing device 20, and a control unit 18 that controls the operation of each unit of the image forming apparatus 10. In addition, in the image forming apparatus 10, a film 16 as an example of a recording medium is transported by a transport unit including a pair of rollers not shown in the drawing.

Image Forming Unit

The image forming unit 12 includes four image forming units 14Y, 14M, 14C, and 14K, as an example. It is indicated that a suffix "Y" to a numerical reference is for yellow, "M" is for magenta, "C" is for cyan, and "K" is for black. The four image forming units 14Y, 14M, 14C, and 14K are constituted by known electrophotographic units including charging, exposing, developing, and transferring. In addition, as an example, the image forming unit 12 forms a toner image TA, formed of a toner T, as an example of a developer on a film 16, using a liquid developer G. The toner image TA is an example of a developer image.

Film

As an example, the film 16 is constituted by a thermoplastic oriented polypropylene (OPP) film. In addition, the film 16 is a continuous film, is delivered from a delivering roller not shown in the drawing, and is wound by a winding roller not shown in the drawing, and thus the image forming unit 12 and the fixing device 20 are transported to the film in a state where a tensile force is applied to the film.

Toner

The toner T is included in the liquid developer G together with oil not shown in the drawing. In addition, the toner T is formed of a polyester-based resin, as an example. Meanwhile, the oil is formed of silicone oil, as an example.

Main Components

Next, the fixing device 20 will be described.

As shown in FIG. 1, the fixing device 20 includes a preprocessing unit 30 that performs preprocessing on the toner image TA formed on the film 16, and a fixing unit 40 that heats the toner image TA having been subjected to preprocessing by the preprocessing unit 30 to thereby fix the toner image on the film 16. The preprocessing in this exemplary embodiment means heating the toner T at the upstream side with respect to the fixing unit 40 in a transport direction (indicated by an arrow A) of the film 16 in order to increase adhesiveness between the toner T and the film 16.

Preprocessing Unit

Figure 2A:
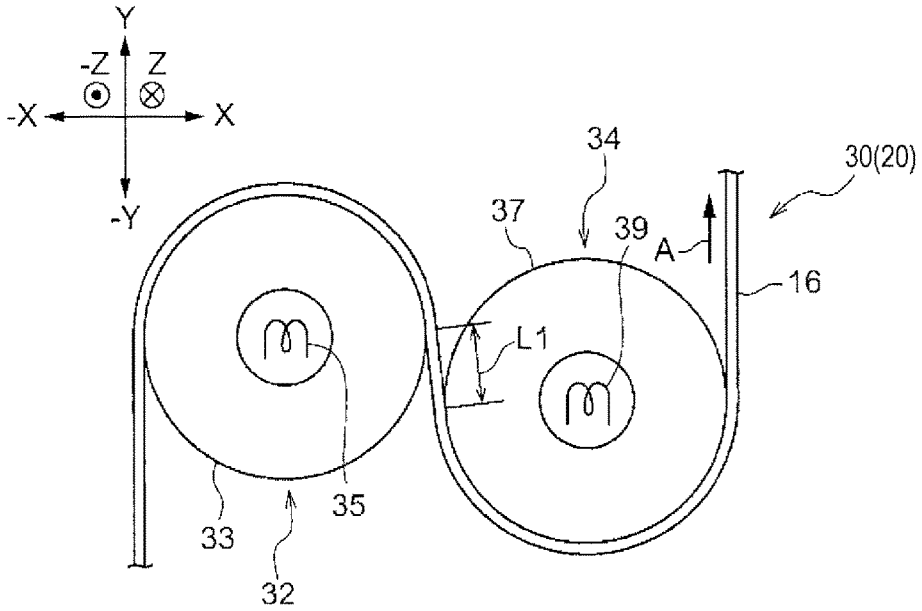
FIG. 2A is a diagram showing a first heating unit and a second heating unit according to the first exemplary embodiment.

As shown in FIG. 2A, the preprocessing unit 30 includes a first heating unit 32 and a second heating unit 34.

First Heating Unit

The first heating unit 32 is disposed at the upstream side with respect to the second heating unit 34 and the fixing unit 40 (see FIG. 1) in the transport direction of the film 16. In addition, the first heating unit 32 includes a first heating roller 33 and a heater 35, as an example. In addition, the first heating unit 32 heats the film 16 so that the temperature of the film 16 is set to a first temperature T1 (not shown). The first temperature T1 is a temperature equal to or greater than a thermal deformation temperature to be described later, and is set to 120° C. in this exemplary embodiment, as an example.

The first heating roller 33 is constituted by a cylindrical metal roller made of aluminum, as an example, and is provided rotatably around the Z-direction as the axial direction. In addition, the first heating roller 33 is configured such that the outer circumferential surface thereof in a range equivalent to a semicircle on the Y side comes into contact with the film 16 when seen in the Z-direction, as an example. In other words, the film 16 is wound around a region of substantially half the outer circumferential surface of the first heating roller 33 in a circumferential direction.

The heater 35 is disposed inside the first heating roller 33. In addition, the heater 35 is configured such that the heating temperature thereof is controlled by a temperature sensor not shown in the drawing and the control unit 18 (see FIG. 1), and heats the first heating roller 33 so that the temperature of the film 16 coming into contact with the first heating roller 33 is set to the first temperature T1.

Thermal Deformation Temperature

The thermal deformation temperature in this exemplary embodiment means temperature that is equal to or lower than the temperature (fixing temperature) of a fixing roller 42 to be described later in the fixing unit 40 and at which the film 16 is deformed. In this exemplary embodiment, a thermal deformation temperature is measured using a method to be described below, as an example.

The film 16 having a width of 250 mm is wound so that the length in the circumferential direction of the film coming into contact with the outer circumferential surface of an aluminum roller having a diameter of 150 mm is set to 150 mm. In addition, the film 16 is transported by the roller by changing the heating temperature of the roller and a tensile force (transport tensile force) of the film 16 that is applied by the roller, with a transport speed of 150 mm/second (heating time is 1 second) as a fixed condition. Here, a deformation rate (%) of the film 16 in a transport direction before and after each heating temperature of the roller is measured. In this measurement result, a transport tensile force is obtained when a deformation rate (%) of the film 16 in the transport direction is set to approximately 0%.

Subsequently, in a state where a transport tensile force (N) of the film 16 is set to a transport tensile force in which a deformation rate (%) in the transport direction is set to approximately 0%, the film 16 is transported by setting the transport speed of the film 16 to 150 mm/second and changing the heating temperature of the roller. In addition, a deformation rate (deformation rate in the width direction) of the film 16 in the axial direction of the roller before and after heating the roller is measured and is set as a heating deformation characteristic of the film 16. In the heating deformation characteristic, a temperature at which an absolute value (contraction rate) of the deformation rate of the film 16 is set to 0.3% is defined as a thermal deformation temperature. In other words, in this exemplary embodiment, a temperature at which a deformation rate of the film 16 in the transport direction is approximately 0% and a deformation rate thereof in the axial direction (width direction) is set to 0.3% (a wrinkle is generated) is defined as a thermal deformation temperature.

Figure 3A:
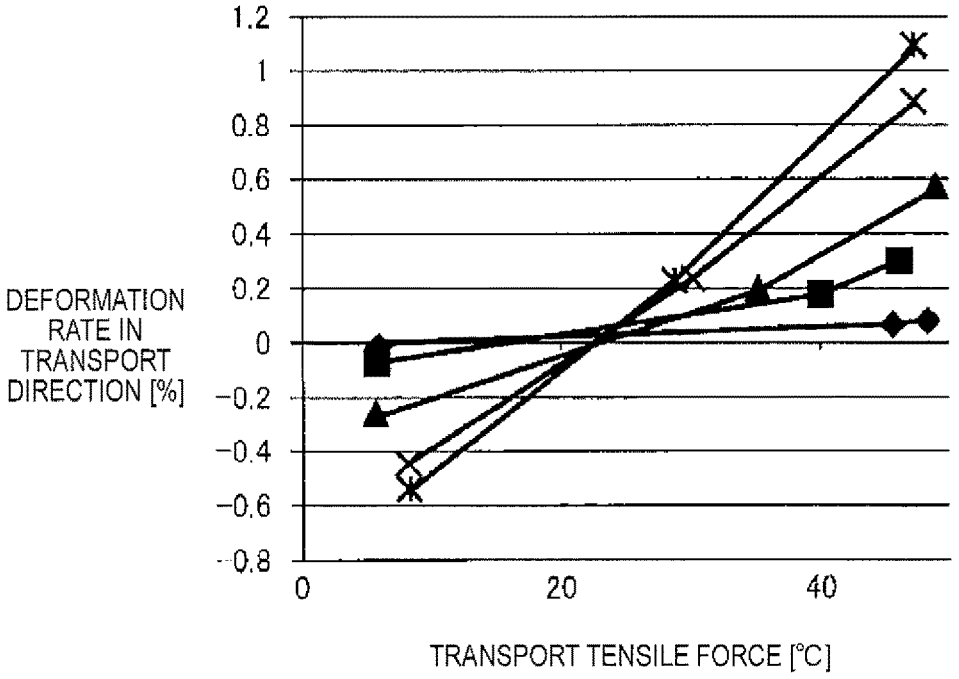
FIG. 3A is a graph showing a relationship between a transport tensile force acting on a film and a deformation rate in a transport direction in a configuration in which a PET film is wound around a first heating roller according to the first exemplary embodiment.
Figure 3B:
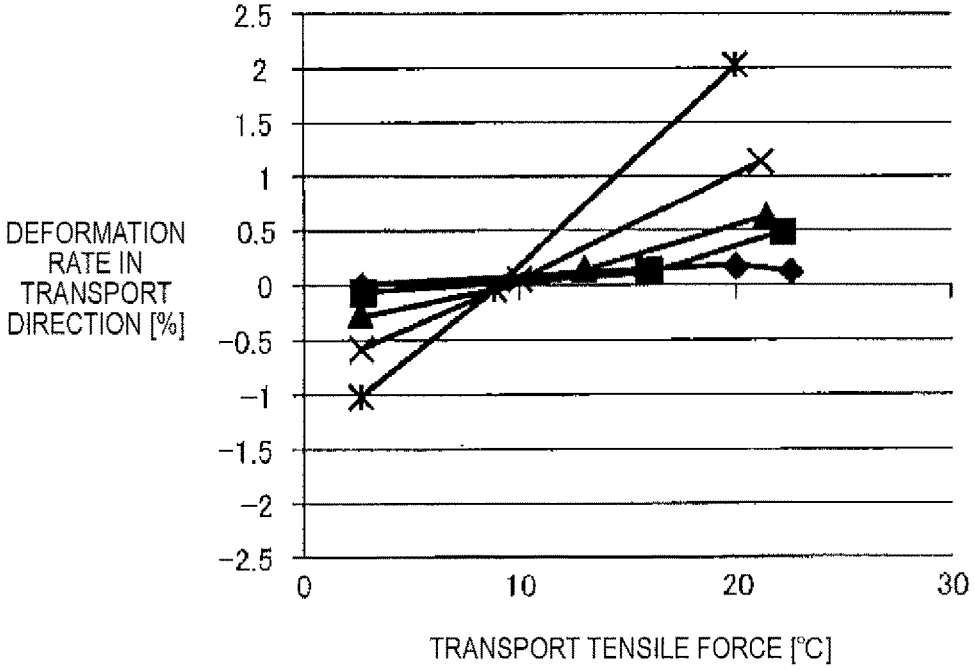
FIG. 3B is a graph showing a relationship between a transport tensile force acting on a film and a deformation rate in a transport direction in a configuration in which an OPP film is wound around the first heating roller according to the first exemplary embodiment.

As an example, FIG. 3A shows a graph showing a relationship between a transport tensile force (N) and a deformation rate (%) in a transport direction when the film 16 is formed of polyethylene terephthalate (PET). As an example, FIG. 3B shows a graph showing a relationship between a transport tensile force (N) and a deformation rate (%) in a transport direction when the film 16 is formed of oriented polypropylene (OPP). Meanwhile, in both FIGS. 3A and 3B, regarding the heating temperature of a roller, a rhomboidal plot indicates 80° C., a square plot indicates 90° C., a triangular plot indicates 100° C., an x plot indicates 110° C., and a * plot indicates 120° C.

In the results of FIG. 3A, a transport tensile force when the deformation rate in a transport direction is set to approximately 0% is approximately 25 N. In the results in FIG. 3B, a transport tensile force when the deformation rate in a transport direction is set to approximately 0% is approximately 10 N.

Figure 4A:
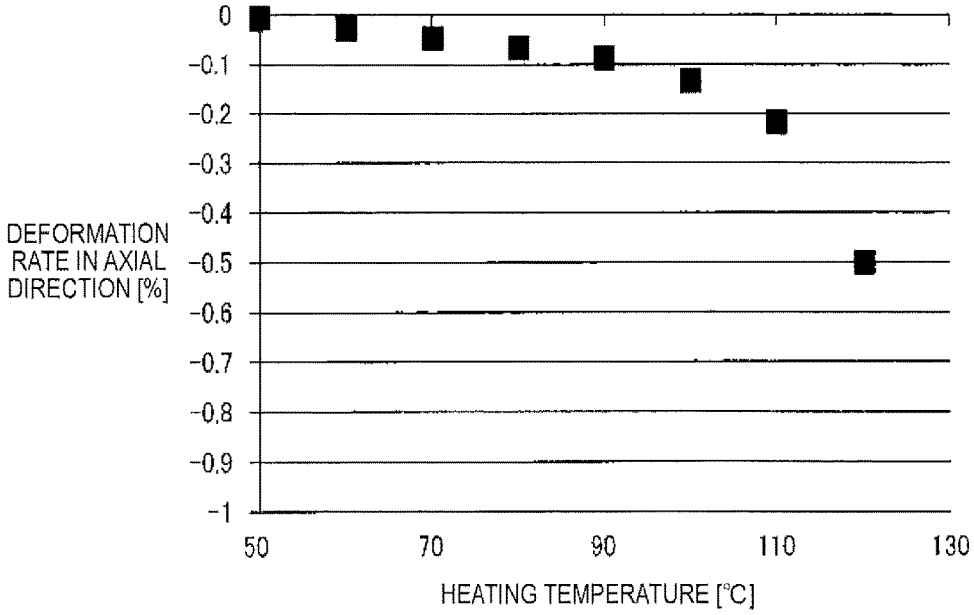
FIG. 4A is a graph showing a relationship between heating temperature of the first heating roller and a deformation rate of a film in a width direction in a state where a deformation rate in a transport direction is set to 0 in a configuration in which a PET film is wound around the first heating roller according to the first exemplary embodiment.
Figure 4B:
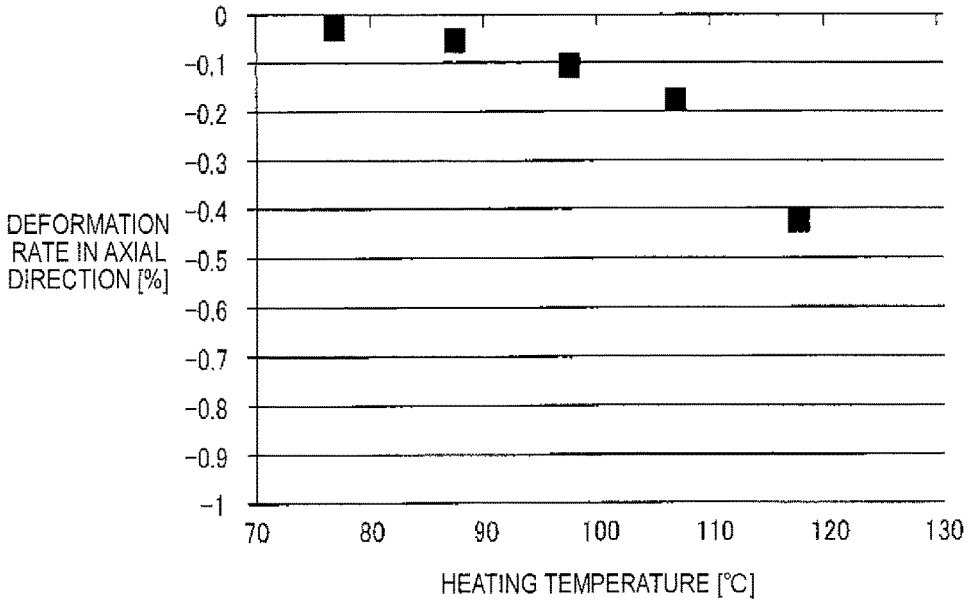
FIG. 4B is a graph showing a relationship between heating temperature of the first heating roller and a deformation rate of a film in a width direction in a state where a deformation rate in a transport direction is set to 0 in a configuration in which an OPP film is wound around the first heating roller according to the first exemplary embodiment.

FIG. 4A shows a relationship between heating temperature (° C.) and a deformation rate (%) in an axial direction when a transport tensile force is set to 25 N on the basis of the results of FIG. 3A. From the results of FIG. 4A, when the film 16 is formed of PET, a thermal deformation temperature is 110° C. In addition, FIG. 4B shows a relationship between a heating temperature (° C.) and a deformation rate (%) in an axial direction when a transport tensile force is set to 10 N on the basis of the results of FIG. 3B. From the results of FIG. 4B, when the film 16 is formed of OPP, a thermal deformation temperature is 110° C.

Other Methods of Measuring Film Deformation Rate

Other methods of measuring a deformation rate of the film 16 will be described. Meanwhile, here, a description will be given by referring to a deformation rate of the film 16 as an expansion and contraction rate.

Figure 7A:
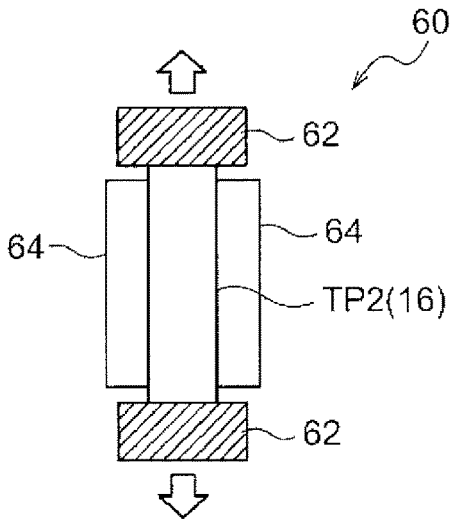
FIG. 7A is a diagram showing a thermal deformation test method of a film according to the first exemplary embodiment.

FIG. 7A shows a thermal deformation test apparatus 60. The thermal deformation test apparatus 60 includes a tensile force unit 62 that pulls a test piece TP2 of the film 16 (see FIG. 1) in the longitudinal direction, and a heating unit 64 that heats the test piece TP2. The heating temperature of the heating unit 64 can be varied. The test piece TP2 is configured such that the length thereof in the lateral direction is 15 mm and the length thereof in the longitudinal direction is 75 mm. The tensile force unit 62 pulls the test piece TP2 and is able to measure a tensile force applied to the test piece TP2. In addition, the tensile force unit 62 is configured to be able to perform a pulling test based on JIS-K-7127:1999. In the thermal deformation test apparatus 60, a tester FGS-TV manufactured by Nidec-Shimpo Corporation is used as an example.

In a thermal deformation test using the thermal deformation test apparatus 60, in a state where the heating unit 64 does not come into contact with the test piece TP2, the test piece TP2 is pulled by 2 mm/min at room temperature (25° C.), and the pulling is stopped when the amount of expansion of the test piece TP2 is set to a predetermined amount of expansion. In addition, a tensile force acting on the test piece TP2 in the predetermined amount of expansion is measured. Meanwhile, a relationship between displacement and a tensile force is shown by a graph G1 (see FIG. 7B).

Next, the heating unit 64 is brought into contact with the test piece TP2 for a fixed period of time. Here, as an example, the heating unit 64 is brought into contact with the test piece TP2 for 2 seconds. The test piece TP2 is expanded by heating, and thus a tensile force is lowered in a direction indicated by an arrow B (see FIG. 7B). At this time, the lowered tensile force is indicated by a plot C (see FIG. 7B).

Figure 7B:
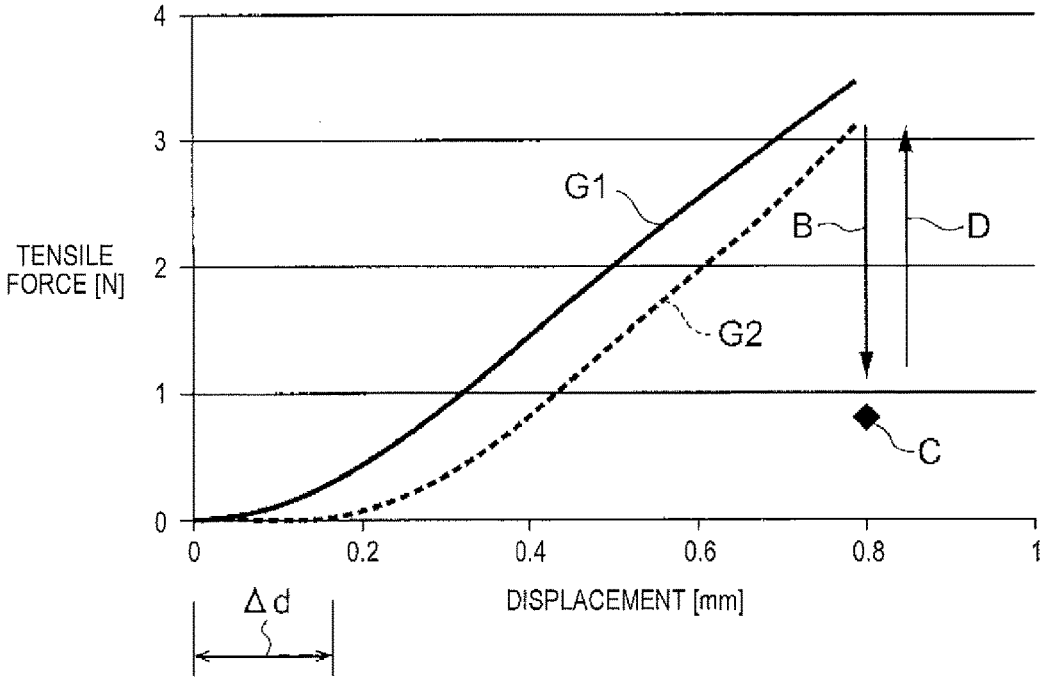
FIG. 7B is a graph showing results of a thermal deformation test of the film according to the first exemplary embodiment.

The test piece TP2 contracts by being cooled to room temperature (25° C.) after the heating of the heating unit 64 is stopped, and thus a tensile force is increased in a direction indicated by an arrow D (see FIG. 7B). In addition, the displacement of the test piece TP2 is returned to its original state by lowering a tensile force acting on the test piece TP2 to thereby obtain the amount of displacement Δd (see FIG. 7B) in which a tensile force acting on the test piece TP2 is set to 0 (zero). The amount of displacement Δd is a residual amount of expansion and contraction mm due to the thermal deformation of the test piece TP2, and a value obtained by dividing the residual amount of expansion and contraction by 75 mm that is the original length of the test piece TP2 is set to be a residual expansion and contraction rate (%). Meanwhile, a relationship between displacement and a tensile force when the displacement of the test piece TP2 is returned to its original state is shown by a graph G2 (see FIG. 7B).

Figure 8A:
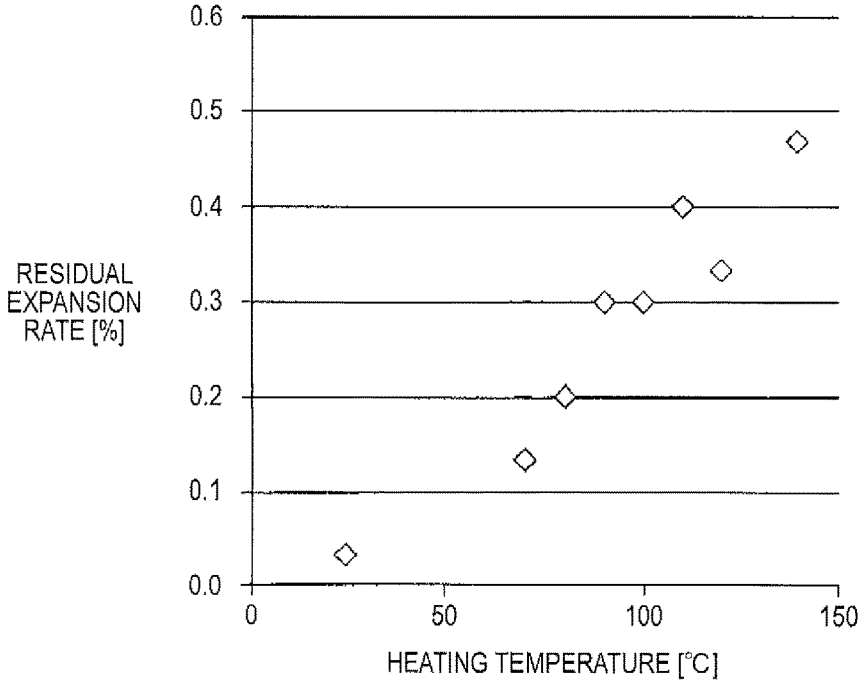
FIG. 8A is a graph showing a relationship between a residual expansion rate of a PET film after cooling (after the second heating roller) and heating temperatures of the first heating roller and the second heating roller according to the first exemplary embodiment.
Figure 8B:
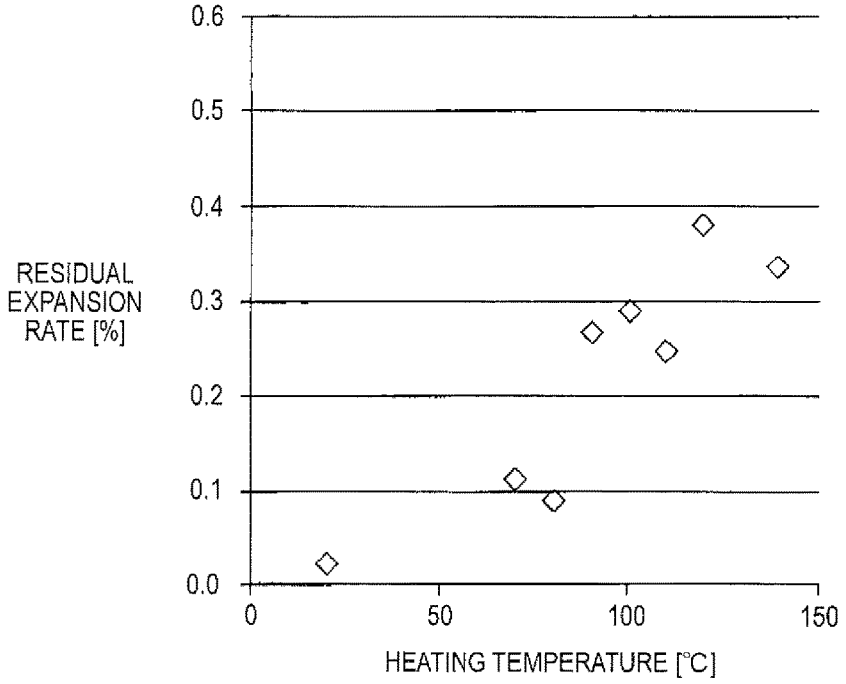
FIG. 8B is a graph showing a relationship between a residual expansion rate of an OPP film after cooling (after the second heating roller) and heating temperatures of the first heating roller and the second heating roller according to the first exemplary embodiment.

Regarding results obtained by performing the above-mentioned test by changing the heating temperature of the test piece TP2, a tensile force acting on the test piece TP2 is converted into the length (as an example, 500 mm) of the film 16 having a tensile force acting thereon in the image forming apparatus 10 and is shown in FIGS. 8A and 8B. Meanwhile, FIG. 8A shows a measurement result of a PET film having a thickness of 12 μm, as an example. FIG. 8B shows a measurement result of an OPP film having a thickness of 20 μm, as an example.

In the results shown in FIGS. 8A and 8B, in a case of a temperature condition in which a difference in residual expansion rate exceeds 0.2%, there is a tendency for a wrinkle to be formed on the film 16. In other words, when a temperature difference between the first heating roller 33 described above and the second heating roller 37 to be described later is converted into a difference in residual expansion rate shown in FIGS. 8A and 8B and is set to a temperature difference (50° C. or higher) exceeding 0.2%, it can be understood that there is a tendency for a wrinkle to be formed. For this reason, in this exemplary embodiment, the heating temperature of the second heating roller 37 is set to 80° C. different from 120° C. which is the heating temperature of the first heating roller 33 by 40° C., as an example.

Meanwhile, when the temperature of the second heating roller 37 is excessively low, there is a tendency for a wrinkle of the film 16 to be fixed, and thus it is preferable that the temperature of the second heating roller 37 is set to temperature at which the film 16 is deformed to a certain extent. From this viewpoint, in this exemplary embodiment, a lower limit of a residual expansion rate is set to 0.05%. In addition, the temperature of the second heating roller 37 is set to a temperature at which a residual expansion rate is set to equal to or greater than 0.05%.

Second Heating Unit

The second heating unit 34 shown in FIG. 2A is disposed at the downstream side with respect to the first heating unit 32 and at the upstream side with respect to the fixing unit 40 (see FIG. 1) in a transport direction of the film 16. In addition, the second heating unit 34 includes the second heating roller 37 and a heater 39, as an example. In this exemplary embodiment, the number of the second heating rollers 37 and the heater 39 provided is one. In addition, the second heating unit 34 heats the film 16 so that the temperature of the film 16 is set at a second temperature T2 (not shown). The second temperature T2 is a temperature (temperature lower than the first temperature T1 mentioned above) that is set to be less than the above-mentioned thermal deformation temperature, and is set at 80° C. as an example in this exemplary embodiment, as described above.

The second heating roller 37 is constituted by an aluminum cylindrical metal roller as an example, and is provided rotatably around the Z-direction as the axial direction. In addition, the second heating roller 37 is configured such that the outer circumferential surface thereof in a range equivalent to a semicircle on the −Y side comes into contact with the film 16 when seen in the Z-direction, as an example. In other words, the film 16 is wound around a region of substantially half the outer circumferential surface of the second heating roller 37 in a circumferential direction. Further, the outer diameter and linear speed of the second heating roller 37 are set so that the second heating roller comes into contact with the film 16 for a period of time equal to or longer than a thermal deformation time to be described later.

The heater 39 is disposed inside the second heating roller 37. In addition, the heater 39 is configured such that the heating temperature thereof is controlled by a temperature sensor not shown in the drawing and the control unit 18 (see FIG. 1), and heats the second heating roller 37 so that the temperature of the film 16 coming into contact with the second heating roller 37 is set to the second temperature T2.

There is no other roller provided between the first heating roller 33 and the second heating roller 37. For this reason, the film 16 separated from the outer circumferential surface of the first heating roller 33 comes into contact with the outer circumferential surface of the second heating roller 37 in a state where a tensile force is applied thereto. A length L1 of the film 16 that is not in contact with the first heating roller 33 and the second heating roller 37 between the first heating roller 33 and the second heating roller 37 is set so that a wrinkle on the film 16 reaching the second heating roller 37 is not fixed (is not excessively cooled).

Thermal Deformation Time

In this exemplary embodiment, a thermal deformation time is defined as a time from a point in time when heating is started to a point in time when a tensile force is lowered by 50% at the time of heating the film 16 having a tensile force applied thereto is heated at the second temperature T2. In other words, it means that the film 16 is deformed when the film 16 is heated for a period of time exceeding the thermal deformation time. In this exemplary embodiment, a thermal deformation time is measured using a method to be described below, as an example.

Figure 5A:
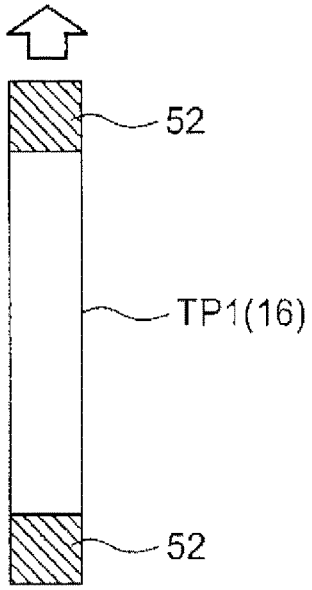
FIG. 5A is a diagram showing a state where a tensile force is applied to a test piece of a film according to the first exemplary embodiment.

As shown in FIG. 5A, the film 16 is cut off to have a length (width) of 15 mm in the lateral direction and a length of 100 mm in the longitudinal direction to thereby be set as a test piece TP1. Both ends of the test piece TP1 in the longitudinal direction are gripped by a gripping member 52. In addition, the test piece TP1 is expanded in the longitudinal direction at a speed of 10 mm/min by moving one of the gripping members 52, and the movement of the gripping member 52 is stopped at a position where a tensile force acting on the test piece TP1 is set to 1.5 N. In this stop state, the test piece TP1 is brought into contact with a heating member (not shown) to thereby measure a relationship between a heating time and a tensile force.

Figure 5B:
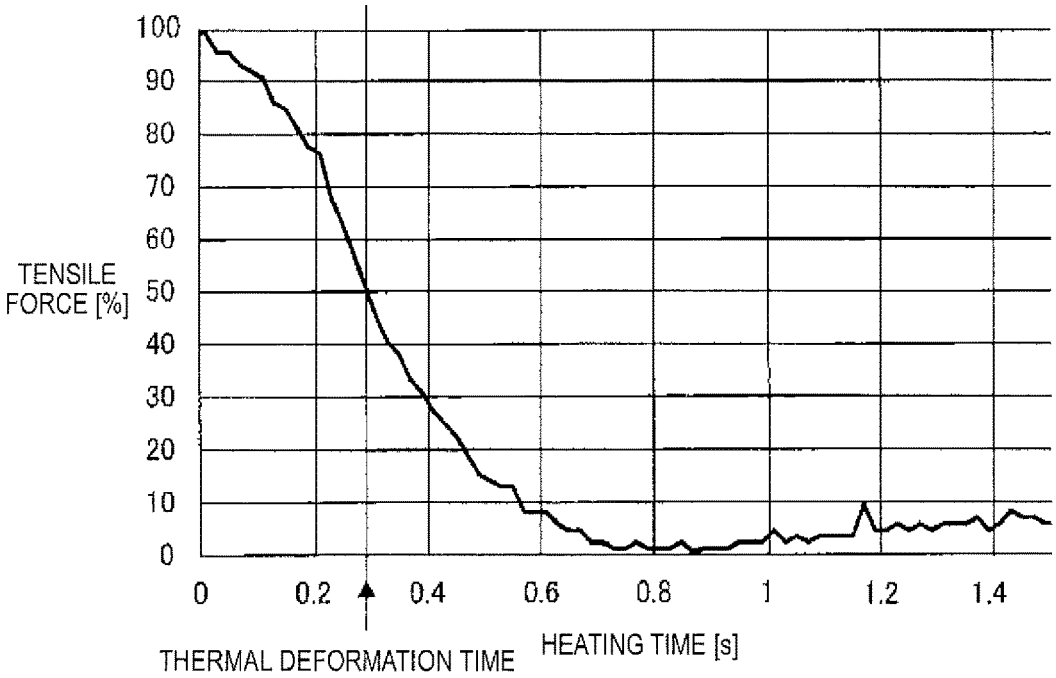
FIG. 5B is a graph showing a relationship between a heating time and a tensile force when the test piece of the film according to the first exemplary embodiment is heated, and a thermal deformation time.

FIG. 5B shows a graph showing a relationship between a heating time and a tensile force that are obtained. The tensile force is indicated by a ratio by setting a tensile force (1.5 N) before heating is performed by a heating member to 100% and setting a saturated tensile force during heating to 0%. Here, as described above, time required for a tensile force to vary from 100% to 50% is a thermal deformation time. In FIG. 5B, as an example, a thermal deformation time is set to approximately 0.3 second.

FIG. 6 shows a thermal deformation time s at the time of changing a heating temperature from 70° C. to 130° C. by 10° C. each time, with respect to two types of films of films A and B formed of different materials. In FIG. 6, the film A is an OPP film, and the film B is a PET film. With respect to the film A, the thermal deformation time is 0.4 second at 70° C., and is 0.3 second at 80° C. or higher and 130° C. or lower. With respect to the film B, the thermal deformation time is 0.5 second at 70° C. or higher and 80° C. or lower, is 0.3 second at 90° C., and is 0.25 second at 100° C. or higher and 130° C. or lower.

Fixing Unit

As shown in FIG. 1, the fixing unit 40 includes a fixing roller 42 as an example of a fixing member and a pressing roller 44 that performs pressing together with the fixing roller 42 with the film 16 interposed therebetween. In addition, the fixing unit 40 is configured such that a set of the fixing roller 42 and the pressing roller 44 are disposed with an interval interposed therebetween in a transport direction of the film 16, as an example. In addition, the fixing unit 40 heats a toner T on the film 16 transported with a tensile force applied thereto to thereby fix the toner on the film 16.

Fixing Roller

The fixing roller 42 is formed to have a cylindrical shape and is provided rotatably around the Z-direction as the axial direction. In addition, the fixing roller 42 is configured to have a multi-layered structure including a core metal, an elastic layer, and a release layer toward the outside from the inside in a radial direction. Further, the fixing roller 42 is provided with a halogen heater 46 therein. In addition, the fixing roller 42 comes into contact with a surface on the side where the toner image TA of the film 16 is formed, to thereby heat and press the toner T.

The halogen heater 46 is feedback-controlled on the basis of an output of a temperature sensor (not shown) which controls the temperature of the fixing roller 42 so that the temperature of the outer circumferential surface of the fixing roller 42 is maintained at 120° C., as an example.

Pressing Roller

The pressing roller 44 is formed to have a cylindrical shape and is rotatably provided with the Z-direction as an axial direction. In addition, the pressing roller 44 is formed to have a multi-layered structure including a core metal, an elastic layer, and a release layer toward the outside from the inside in a radial direction. Further, the pressing roller 44 is biased toward the fixing roller 42 by using a biasing unit, not shown in the drawing, such as a spring. In addition, the pressing roller 44 is provided with a halogen heater 48 therein. The halogen heater 48 is feedback-controlled on the basis of an output of a temperature sensor (not shown) that detects the temperature of the pressing roller 44 so that the temperature of the outer circumferential surface of the pressing roller 44 is maintained at 120° C., as an example. In addition, the pressing roller 44 comes into contact with a surface on a side opposite to the side where the toner image TA of the film 16 is formed, to thereby heat and press the toner T together with the fixing roller 42.

Wrinkle Occurrence Mechanism

FIG. 16A shows a state where the film 16 is wound around the outer circumferential surface of the first heating roller 33. A tensile force F1 along the transport direction and a vertical drag F2 in a direction, which is perpendicular to the transport direction, act on the film 16 that comes into contact with the outer circumferential surface of the first heating roller 33.

As shown in FIG. 16B, the film 16 is heated to a temperature equal to or higher than the above-mentioned thermal deformation temperature by coming into contact with the first heating roller 33 (region S1). In addition, the film 16 is separated from the outer circumferential surface of the first heating roller 33 at a temperature equal to or higher than the thermal deformation temperature. At this time, the vertical drag F2 (see FIG. 16A) having acted from the first heating roller 33 stops acting, and thus a wrinkle K1 occurs due to the bending of the film 16 (region S2). When the occurred wrinkle K1 is cooled to the thermal deformation temperature or less due to heat radiation, the wrinkle is fixed on the film 16 as a wrinkle K2 of a vertical stripe along the transport direction (region S3). In this manner, as a comparative example, in a configuration in which the film is separated from the first heating roller 33 after being heated by the first heating roller 33 and is naturally cooled without coming into contact with other members, the film has the wrinkle K2 fixed thereon.

Effects

Next, effects of the first exemplary embodiment will be described.

In the image forming apparatus 10 shown in FIG. 1, the toner image TA is formed on the film 16 to be transported, by the image forming unit 12. The toner image TA formed on the film 16 is preprocessed (heated) by the preprocessing unit 30 of the fixing device 20 and is then heated and processed by the fixing unit 40, to thereby be fixed on the film 16.

Figure 2B:
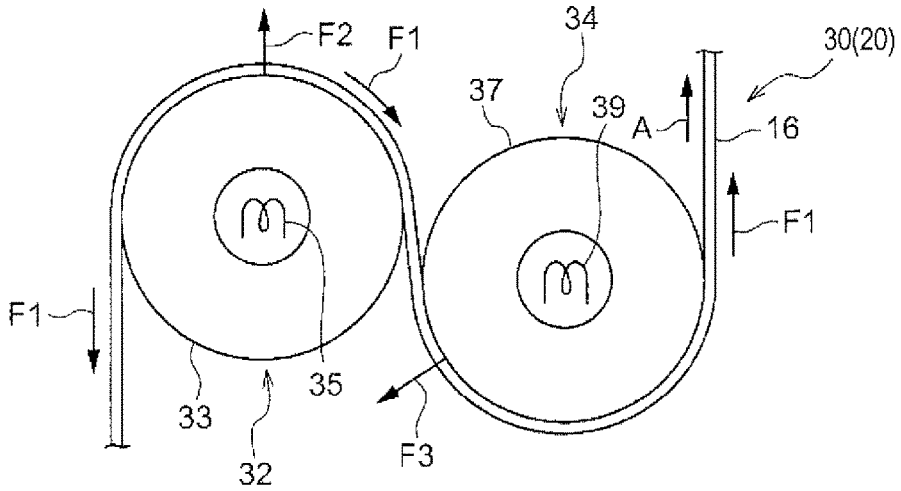
FIG. 2B is a diagram showing a force acting on a film in each of the first heating unit and the second heating unit according to the first exemplary embodiment.

In the preprocessing unit 30 shown in FIG. 2B, the film 16 is heated to the first temperature T1 (not shown), which is equal to or higher than a thermal deformation temperature by the first heating roller 33 in the first heating unit 32. At this time, the tensile force F1 acts on the film 16 coming into contact with the outer circumferential surface of the first heating roller 33, together with the vertical drag F2. For this reason, in the first heating unit 32, the occurrence of a wrinkle on the film 16 is suppressed as compared to a case where the vertical drag F2 does not act on the film 16.

Subsequently, the vertical drag F2 does not act on the film 16 having passed through the first heating unit 32, and thus a wrinkle tends to occur due to an effect of the heating at the first temperature T1 and an effect of the tensile force F1. Here, the film 16 separated from the first heating roller 33 comes into contact with the outer circumferential surface of the second heating roller 37. For this reason, the film 16 is subject to a vertical drag F3 from the outer circumferential surface of the second heating roller 37. Further, the film 16 is heated at the second temperature T2 (not shown), which is lower than the thermal deformation temperature by coming into contact with the second heating roller 37, and thus a sudden temperature drop from the first temperature T1 is suppressed. In addition, the film 16 comes into contact with the second heating roller 37 for a period of time equal to or longer than a thermal deformation time and is heated.

In this manner, in the fixing device 20, the vertical drag F3 acts on the film 16 by the second heating roller 37, and thus the deformation of the film 16 is suppressed. In addition, in the fixing device 20, the film 16 is heated at the second temperature T2 by the second heating roller 37, and thus a sudden temperature drop of the film 16 from the first temperature T1 is suppressed. Further, in the fixing device 20, the second heating roller 37 comes into contact with the film 16 for a period of time equal to or longer than a thermal deformation time, and thus the fixation of a wrinkle occurred on the film 16 is suppressed. By these effects, in the fixing device 20, a wrinkle is not likely to be fixed as compared to a configuration in which the film 16 is naturally cooled between the first heating unit 32 and the fixing unit 40 (see FIG. 1), and thus the occurrence of a wrinkle on the film 16 transported from the first heating unit 32 to the fixing unit 40 is suppressed.

In addition, in the fixing device 20, the vertical drag F2 acts on the film 16 by the first heating roller 33 coming into contact with the film 16, and thus the film 16 is not as likely to be bent compared to a configuration in which the first heating roller 33 does not come into contact with the film 16. Thereby, the occurrence of a wrinkle on the film 16 is suppressed.

Further, the number of second heating roller 37 provided in the fixing device 20 is one. Thereby, it is possible to prevent the film 16 from separating from one second heating roller 37 to the other second heating roller 37 (from being temporarily cooled) during heating at the second temperature T2 as compared to a configuration in which the number of second heating rollers 37 is two or more, and thus the occurrence of a wrinkle on the film 16 is suppressed.

In the image forming apparatus 10 shown in FIG. 1, the occurrence of a wrinkle on the film 16 is suppressed in the fixing device 20 as described above. Thereby, when the toner image TA is fixed on the film 16, an image defect (for example, partial peeling-off of the toner image TA) that occurs due to an increase in the number of wrinkles of the film 16 is suppressed.

Figure 9:
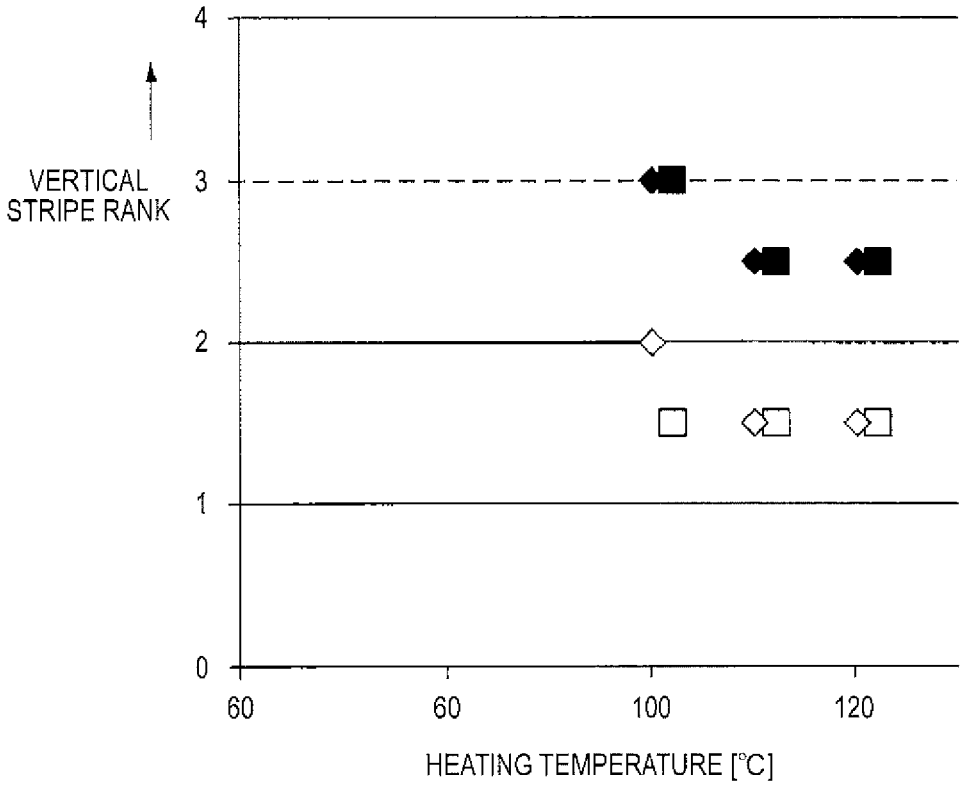
FIG. 9 is a graph showing a relationship between a heating temperature of a film and an evaluation rank of a vertical stripe occurring on the film in the image forming apparatus according to the first exemplary embodiment and an image forming apparatus of a comparative example.

FIG. 9 shows a state where a wrinkle occurs (vertical stripe rank) when a heating temperature is varied to 100° C., 110° C., and 120° C. in the first heating roller 33 (see FIG. 2A). Meanwhile, a white rhomboidal plot in FIG. 9 relates to a comparative example, and represents a result of a combination of an OPP film and no second heating unit 34 (see FIG. 2A). A white square plot relates to a comparative example, and represents a result of a combination of a PET film and no second heating unit 34 (see FIG. 2A). A black rhomboidal plot relates to this exemplary embodiment, and represents a result using an OPP film. A black square plot relates to this exemplary embodiment, and represents a result using a PET film. Data at 100° C. is reference data.

The vertical stripe rank is indicated from a rank 1 to a rank 4 at an interval of 0.5. When the fixed film 16 is viewed, the rank 4 is set for the vertical stripe rank having a vertical stripe that is not satisfactory, the rank 3 is set for the vertical stripe rank having a few vertical stripes, the rank 2 is set for the vertical stripe rank having a clear vertical stripe, and the rank 1 is set for the vertical stripe having a large number of clear vertical stripes. Here, as shown in FIG. 9, from the results of the fixing device 20 (see FIG. 1) of this exemplary embodiment, it is confirmed that the vertical stripe rank increases as compared to the results of the comparative example.

Figure 12A:
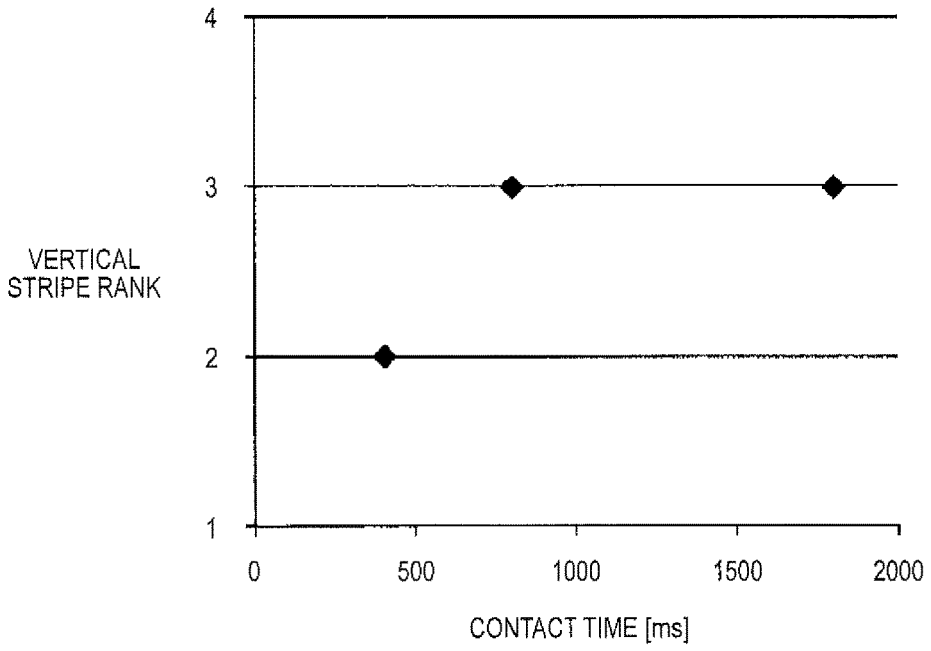
FIG. 12A is a graph showing a relationship between a contact time and an evaluation rank of a vertical stripe in one second heating roller according to the first exemplary embodiment.

FIG. 12A shows a relationship between a contact time and a vertical stripe rank in the fixing device 20 (see FIG. 2A). The contact time means a time (heating time) for which the second heating roller 37 (see FIG. 2A) contacts the film 16. Meanwhile, regarding setting conditions, the film 16 is formed of PET, the temperature of the first heating roller 33 is set at 120° C., and the temperature of the second heating roller 37 is set at 80° C. From results shown in FIG. 12A, when a time for which the film 16 is cooled by the second heating roller 37 is increased, it is confirmed that a vertical stripe rank increases. However, there is little difference in heating for 1 second or longer.

Second Exemplary Embodiment

Next, examples of a fixing device and an image forming apparatus according to a second exemplary embodiment will be described. Meanwhile, members and portions that are basically the same as those in the first exemplary embodiment described above will be denoted by the same reference numerals and signs as those in the first exemplary embodiment, and a description thereof will not be repeated.

Figure 10A:
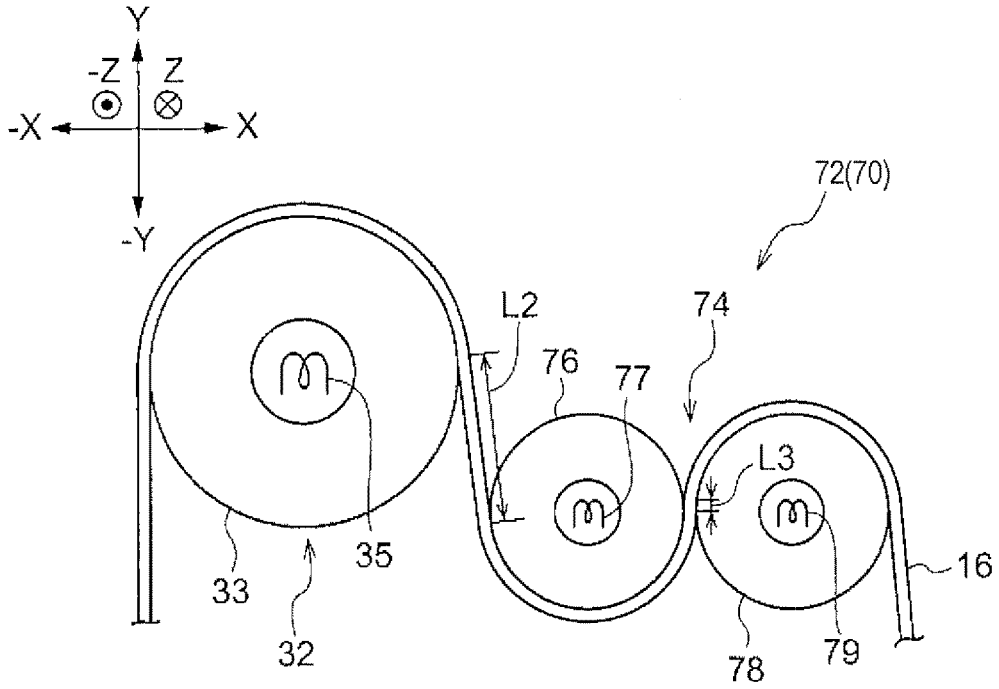
FIG. 10A is a diagram showing a first heating unit and a second heating unit according to a second exemplary embodiment.

FIG. 10A shows a fixing device 70 according to the second exemplary embodiment. The fixing device 70 is provided instead of the fixing device 20 (see FIG. 1) in the image forming apparatus 10 (see FIG. 1) of the first exemplary embodiment. In addition, the fixing device 70 includes a preprocessing unit 72 and a fixing unit 40 (see FIG. 1). The preprocessing unit 72 includes a first heating unit 32 and a second heating unit 74.

The second heating unit 74 is provided at the downstream side with respect to the first heating unit 32 and at the upstream side with respect to the fixing unit 40 (see FIG. 1) in a transport direction of a film 16. In addition, the second heating unit 74 includes second heating rollers 76 and 78 and heaters 77 and 79, as an example. Further, the second heating unit 74 heats the film 16 so that the temperature of the film 16 is set at a second temperature T2 (not shown). In the second exemplary embodiment, the second temperature T2 is set at 80° C., as an example.

The second heating rollers 76 and 78 are constituted by an aluminum cylindrical metal roller as an example, and are provided side by side in the X-direction and rotatably around the Z-direction as the axial direction. The outer diameter of each of the second heating rollers 76 and 78 is smaller than the outer diameter of the second heating roller 37 (see FIG. 2A) of the first exemplary embodiment. In addition, the outer diameter of the second heating roller 76 and the outer diameter of the second heating roller 78 are approximately the same size. The film 16 transported from a first heating roller 33 is wound around the outer circumferential surface of each of the second heating rollers 76 and 78 in an S shape, as an example.

Further, the outer diameter and linear velocity of each of the second heating rollers 76 and 78 are set so that the second heating rollers come into contact with the film 16 for a period of time equal to or longer than the above-mentioned thermal deformation time. Meanwhile, a contact time between the second heating roller 37 (see FIG. 2B) and the film 16 in the first exemplary embodiment is set to t1. In addition, a contact time between the second heating roller 76 and the film 16 is set to t2, and a contact time between the second heating roller 78 and the film 16 is set to t3. Here, the relation of t1=t2+t3 is established, as an example.

A heater 77 is provided inside the second heating roller 76, and heats the second heating roller 76 so that the temperature of the temperature and film 16 of the second heating roller 76 is set at a second temperature T2. A heater 79 is disposed inside the second heating roller 78, and heats the second heating roller 78 so that the temperature of the temperature and film 16 of the second heating roller 78 is set at the second temperature T2. The heating temperature of each of the heaters 77 and 79 is controlled by a temperature sensor not shown in the drawing and the control unit 18 (see FIG. 1).

There is no other roller between the first heating roller 33 and the second heating roller 76. For this reason, the film 16 separated from the outer circumferential surface of the first heating roller 33 comes into contact with the outer circumferential surface of the second heating roller 76 in a state where a tensile force is applied thereto. Here, a length L2 of the film 16 that is not in contact with the first heating roller 33 and the second heating roller 76 between the first heating roller 33 and the second heating roller 76 is set so that a wrinkle of the film 16 reaching the second heating roller 76 is not fixed. In addition, a length L3 (<L2) of the film 16 that is not in contact with the second heating roller 76 and the second heating roller 78 between the second heating roller 76 and the second heating roller 78 is set so that a wrinkle of the film 16 reaching the second heating roller 78 is not fixed.

Effects

Next, effects of the second exemplary embodiment will be described.

Figure 10B:
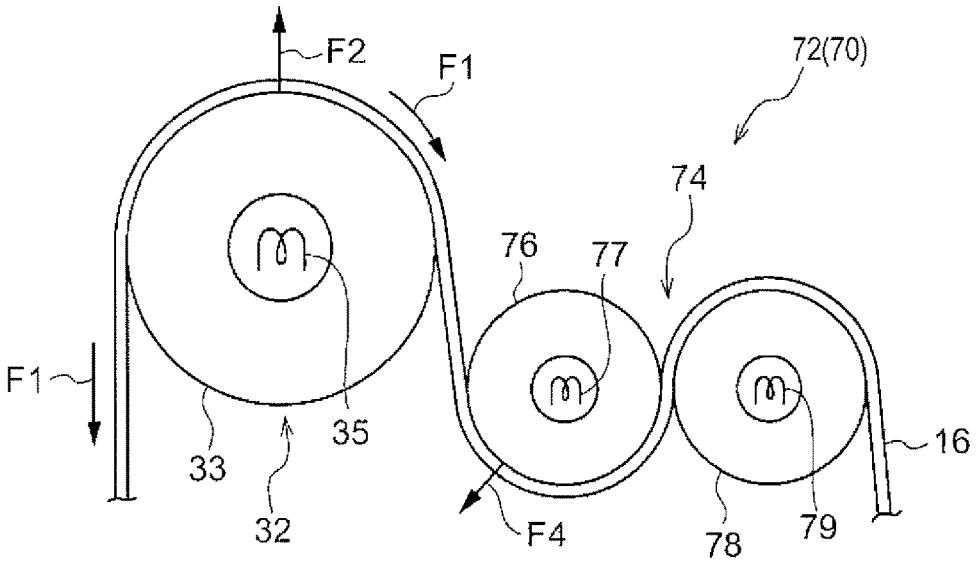
FIG. 10B is a diagram showing a force acting on a film in each of the first heating unit and the second heating unit according to the second exemplary embodiment.

In the preprocessing unit 72 shown in FIG. 10B, the film 16 is heated at a first temperature T1 (not shown), which is equal to or higher than a thermal deformation temperature by the first heating roller 33 in the first heating unit 32. Subsequently, the vertical drag F2 does not act on the film 16 having passed through the first heating unit 32, and thus a wrinkle tends to occur due to an effect of the heating at the first temperature T1 and an effect of the tensile force F1. Here, the film 16 separated from the first heating roller 33 comes into contact with the outer circumferential surface of the second heating roller 76. For this reason, the film 16 is subject to a vertical drag F4 from the outer circumferential surface of the second heating roller 76.

Further, the film 16 is heated at the second temperature T2, which is lower than the thermal deformation temperature for a period of time equal to or longer than a thermal deformation time by coming into contact with the second heating rollers 76 and 78, and thus a sudden temperature drop from the first temperature T1 is suppressed. By these effects, in the fixing device 70, a wrinkle is not likely to be fixed as compared to a configuration in which the film 16 is naturally cooled between the first heating unit 32 and the fixing unit 40 (see FIG. 1), and thus the occurrence of a wrinkle on the film 16 transported from the first heating unit 32 to the fixing unit 40 is suppressed.

In the image forming apparatus 10 (see FIG. 1), the occurrence of a wrinkle on the film 16 is suppressed by the fixing device 70. Thereby, when a toner image TA (see FIG. 1) is fixed on the film 16, an image defect (for example, partial peeling-off of the toner image TA) that occurs due to an increase in the number of wrinkles of the film 16 is suppressed.

First Modification Example

Figure 11:
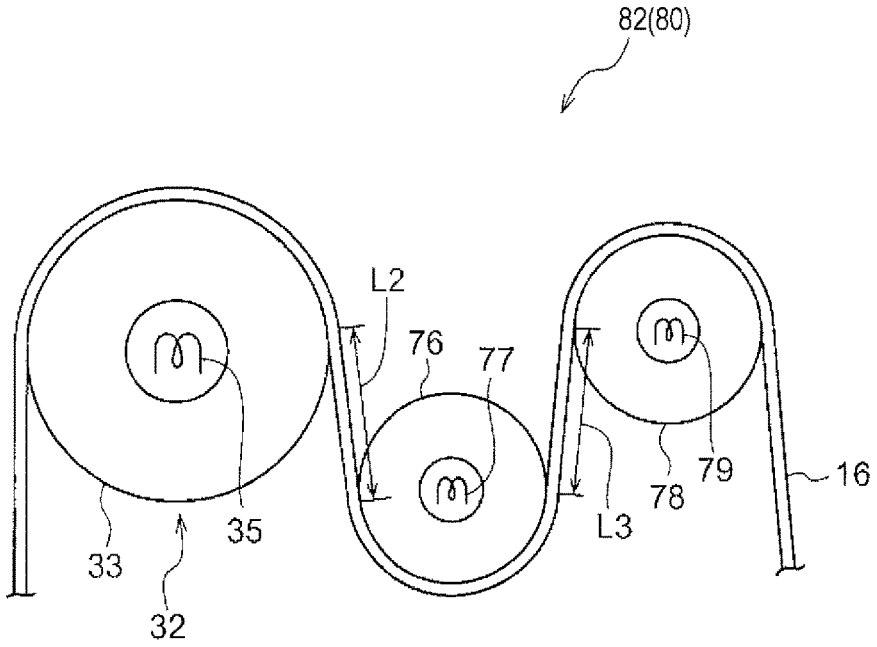
FIG. 11 is a diagram showing a first heating unit and a second heating unit according to a first modification example.

FIG. 11 shows a preprocessing unit 82 of a fixing device 80, as a first modification example with respect to the fixing device 70 (see FIG. 10A) of the second exemplary embodiment. In the fixing device 80, a length L3 of the film 16 that is not in contact with the second heating roller 76 and the second heating roller 78 between the second heating roller 76 and the second heating roller 78 is longer than the length L3 (see FIG. 10A) of the second exemplary embodiment. However, the length L3 of the first modification example is set so that a wrinkle of the film 16 reaching the second heating roller 78 is not fixed. In this manner, in a configuration in which the occurrence of a wrinkle is suppressed, the second heating roller 76 and the second heating roller 78 may be disposed so as to be separated from each other.

Figure 12B:
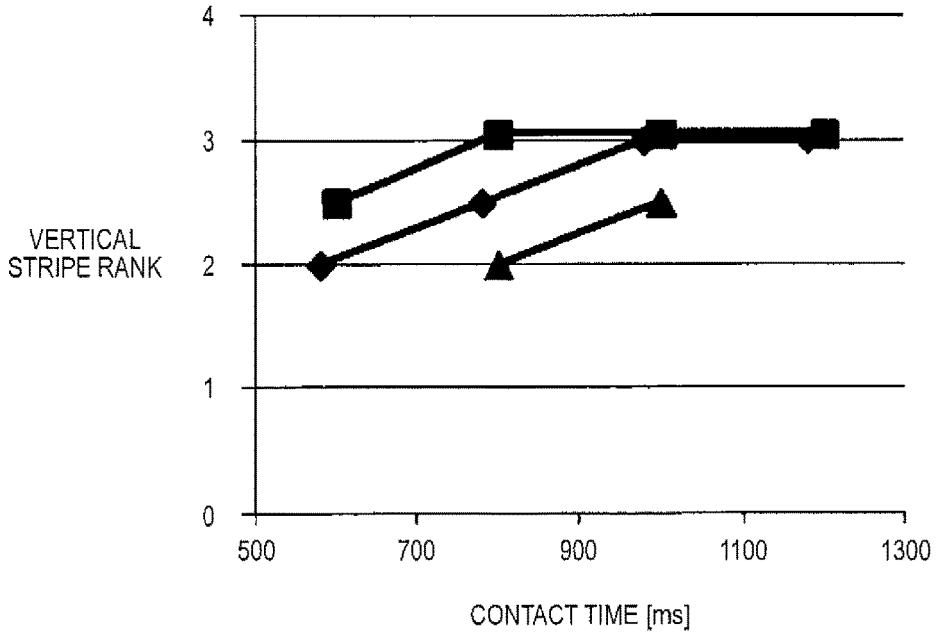
FIG. 12B is a graph showing a relationship between a total contact time and an evaluation rank of a vertical stripe in two second heating rollers according to the second exemplary embodiment.

FIG. 12B shows a relationship between a vertical contact time and a vertical stripe rank in the fixing device 70 (see FIG. 10A). The vertical contact time means a total of times (heating times) between each of the second heating rollers 76 and 78 (see FIG. 10A) and the film 16. Meanwhile, a black rhomboidal plot represents data using a PET film 16, a black square plot represents data using an OPP film 16, and a black triangular plot represents data using an oriented nylon (ONY) film 16. In addition, the temperature of the first heating roller 33 is set at 120° C., and the temperature of each of the second heating rollers 76 and 78 is set at 80° C. From results shown in FIG. 12B, even when materials of the films 16 are different from each other, it is confirmed that the vertical stripe rank increases when the vertical contact time of the film 16 by the second heating rollers 76 and 78 increases.

Figure 13A:
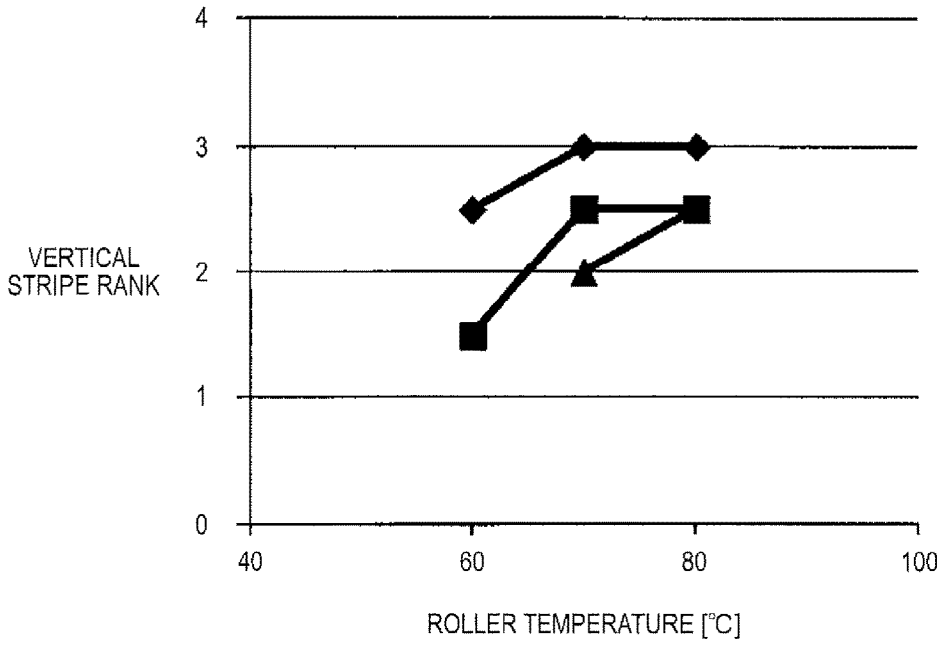
FIG. 13A is a graph showing a relationship between a second heating roller temperature and an evaluation rank of a vertical stripe when a PET film is used in the image forming apparatuses according to the first and second exemplary embodiments and the first modification example.

FIG. 13A shows a vertical stripe rank when a roller temperature of each of the second heating rollers 37, 76, and 78 is varied between 60° C. and 80° C. using a PET film 16 in the fixing devices 20, 70, and 80 mentioned above. The temperature of the first heating roller 33 is set to 120° C., and a tensile force of the film 16 is set to 50 N/500 mm.

Figure 13B:
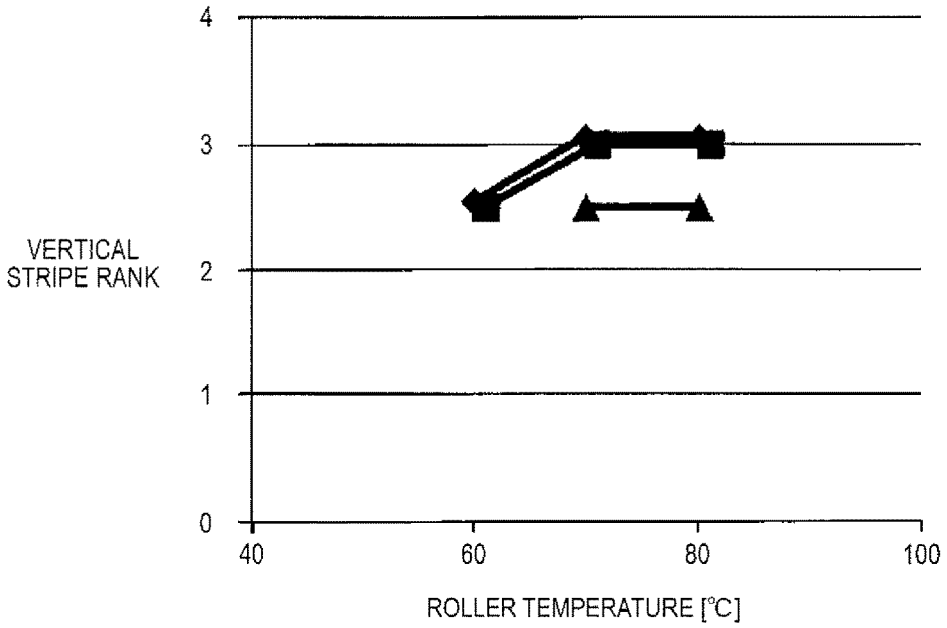
FIG. 13B is a graph showing a relationship between a second heating roller temperature and an evaluation rank of a vertical stripe when an OPP film is used in the image forming apparatuses according to the first and second exemplary embodiments and the first modification example.

FIG. 13B shows a vertical stripe rank when a roller temperature of each of the second heating rollers 37, 76, and 78 is varied between 60° C. and 80° C. using an OPP film 16 in the fixing devices 20, 70, and 80 mentioned above. The temperature of the first heating roller 33 is set to 120° C., and tensile force of the film 16 is set to 20 N/500 mm.

In both FIGS. 13A and 13B, a black rhomboidal plot represents data of the fixing device 20, a black square plot represents data of the fixing device 70, and a black triangular plot represents data of the fixing device 80. In addition, in any of the fixing devices 20, 70, and 80, the contact time (total) between the film 16 and the second heating rollers is set to 800 milliseconds.

From results shown in FIGS. 13A and 13B, it is confirmed that a vertical stripe rank becomes higher in order of the fixing device 20, the fixing device 70, and the fixing device 80.

This indicates that the vertical stripe rank increases as a time for which the second heating roller thereof and the film 16 are not in contact with each other within a second heating unit becomes shorter.

Third Exemplary Embodiment

Next, examples of a fixing device and an image forming apparatus according to a third exemplary embodiment will be described. Meanwhile, members and portions that are basically the same as those in the first and second exemplary embodiments described above will be denoted by the same reference numerals and signs as those in the first and second exemplary embodiments, and a description thereof will not be repeated.

Figure 14A:
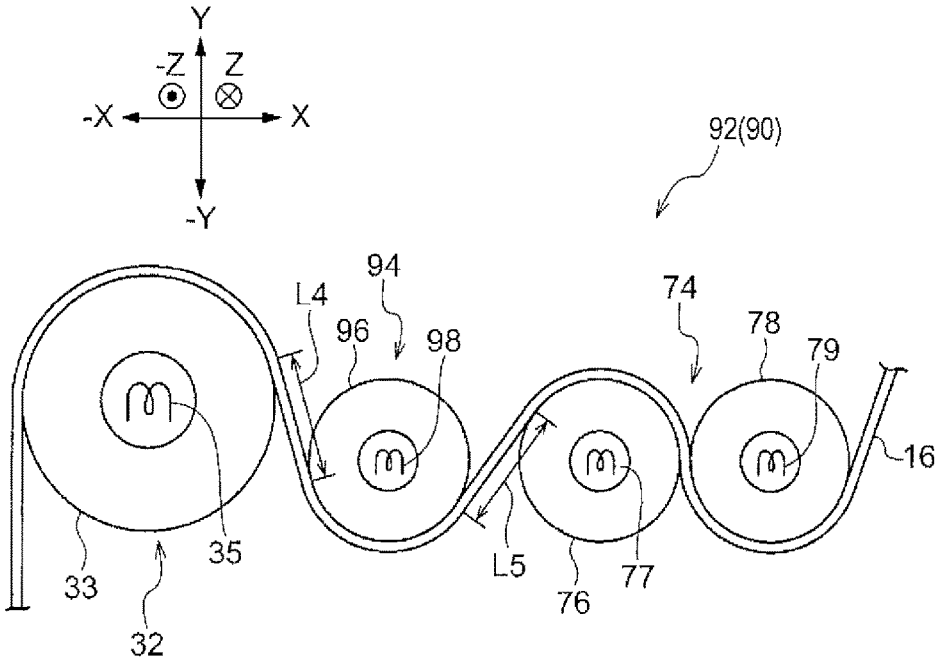
FIG. 14A is a diagram showing first, second, and third heating units according to a third exemplary embodiment.

FIG. 14A shows a fixing device 90 according to the third exemplary embodiment. The fixing device 90 is provided instead of the fixing device 20 (see FIG. 1) in the image forming apparatus 10 (see FIG. 1) of the first exemplary embodiment. In addition, the fixing device 90 includes a preprocessing unit 92 and a fixing unit 40 (see FIG. 1). The preprocessing unit 92 includes a first heating unit 32, a third heating unit 94, and a second heating unit 74.

The third heating unit 94 is provided at the downstream side with respect to a first heating unit 32 and at the upstream side with respect to a second heating unit 74 in a transport direction of a film 16. The third heating unit 94 includes an intermediate roller 96 and a heater 98, as an example. Further, the third heating unit 94 comes into contact with the film 16 to heat the film 16 at a third temperature T3 (not shown), which is lower than a first temperature T1 and a thermal deformation temperature and is higher than a second temperature T2. In the third exemplary embodiment, the third temperature T3 is set at 100° C., as an example. In other words, the third temperature T3 is set so that a temperature gradient of the film 16 between a first heating roller 33 and a second heating roller 76 becomes smaller.

The intermediate roller 96 is constituted by an aluminum cylindrical metal roller as an example, and is provided rotatably around the Z-direction as the axial direction. The outer diameter of the intermediate roller 96 is substantially the same as the outer diameter of the second heating roller 76. The film 16 transported from the first heating roller 33 is wound around the outer circumferential surface of the intermediate roller 96. Further, a contact time between the intermediate roller 96 and the film 16 is shorter than the above-mentioned contact time t2 (not shown) between the second heating roller 76 and the film 16, as an example.

The heater 98 is disposed inside the intermediate roller 96, and heats the intermediate roller 96 so that the temperature of the film 16 coming into contact with the intermediate roller 96 is set to the third temperature T3. Meanwhile, the heating temperature of the heater 98 is controlled by a temperature sensor not shown in the drawing and the control unit 18 (see FIG. 1).

The length of the film 16 in a non-contact state between the first heating roller 33 and the intermediate roller 96 is set to LA. In addition, the length of the film 16 in a non-contact state between the intermediate roller 96 and the second heating roller 76 is set to L5. Here, the lengths L4 and L5 are set so that a wrinkle of the film 16 reaching the second heating roller 76 is not fixed.

Effects

Next, effects of the third exemplary embodiment will be described.

Figure 14B:
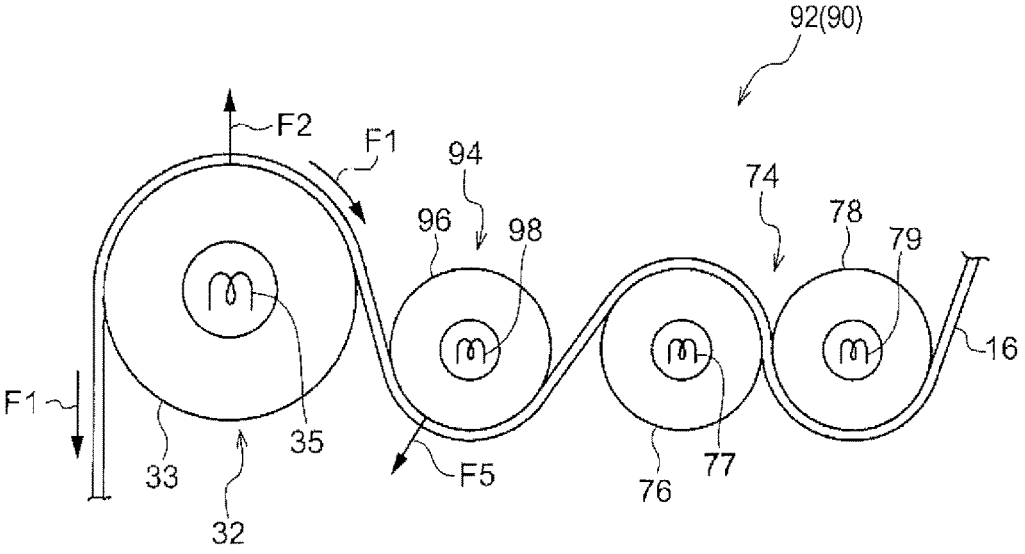
FIG. 14B is a diagram showing a force acting on a film in the first, second, and third heating units according to the third exemplary embodiment.

In the preprocessing unit 92 shown in FIG. 14B, in the first heating unit 32, the film 16 is heated at the first temperature T1 equal to or higher than the thermal deformation temperature by the first heating roller 33. Subsequently, the vertical drag F2 does not act on the film 16 having passed through the first heating unit 32, and thus a wrinkle tends to occur due to an effect of the heating at the first temperature T1 and an effect of the tensile force F1. Here, the film 16 separated from the first heating roller 33 comes into contact with the outer circumferential surface of the intermediate roller 96. For this reason, the film 16 is subject to a vertical drag F5 from the outer circumferential surface of the intermediate roller 96.

In the intermediate roller 96, the film 16 is heated at the third temperature T3 which is lower than the first temperature T1 and is higher than the second temperature T2. In other words, a temperature drop from the first temperature T1 to the second temperature T2 is suppressed by the film 16 coming into contact with the intermediate roller 96. In other words, a temperature gradient (temperature change) of the film 16 between the first heating unit 32 and the second heating unit 74 becomes smaller than that in a configuration in which the third heating unit 94 is not provided, and thus the occurrence of a wrinkle on the film 16 is suppressed.

The film 16 transported from the intermediate roller 96 to the second heating unit 74 is heated at the second temperature T2 for a period of time equal to or longer than a thermal deformation time by coming into contact with the second heating rollers 76 and 78, and thus a sudden temperature drop from the third temperature T3 is suppressed. By these effects, in the fixing device 90, a wrinkle is not likely to be fixed as compared to a configuration in which the film 16 is naturally cooled between the first heating unit 32 and the fixing unit 40 (see FIG. 1), and thus the occurrence of a wrinkle on the film 16 transported from the first heating unit 32 to the fixing unit 40 is suppressed.

In the image forming apparatus 10, the occurrence of a wrinkle on the film 16 is suppressed in the fixing device 90, as described above. Thereby, when a toner image TA (see FIG. 1) is fixed on the film 16, an image defect (for example, partial peeling-off of the toner image TA) that occurs due to an increase in the number of wrinkles of the film 16 is suppressed.

FIG. 15 shows an evaluation rank of a vertical stripe when films A, B, and C are used with respect to apparatuses A, B, and C. The apparatus A is the fixing device 20 (see FIG. 2A). The apparatus B is the fixing device 70 (see FIG. 10A). The apparatus C is the fixing device 90 (see FIG. 14A). In addition, the film A is formed of PET, the film B is formed of OPP, and the film C is formed of ONY. Regarding the first heating unit 32, a heating temperature is set at 120° C. Regarding the second heating units 34 and 74, a contact time (total) between the film 16 and the rollers is set to 800 milliseconds. In addition, regarding the second heating units 34 and 74, a heating temperature is set at 80° C. Regarding the third heating unit 94, a heating temperature is set at 100° C., and a contact time between the intermediate roller 96 and the film 16 is set to 320 milliseconds.

From results shown in FIG. 15, it is confirmed that the vertical stripe rank of apparatus C (fixing device 90) is highest and the vertical stripe ranks of the apparatus A (fixing device 20) and the apparatus B (fixing device 70) are at the same level. This indicates that a temperature gradient of a film between a first heating unit and a second heating unit becomes smaller when a third heating unit set to a temperature, which is an intermediate temperature between a heating temperature and a thermal deformation temperature, is provided between a first heating unit and a second heating unit in a case where the heating temperature in the first heating unit is higher than the thermal deformation temperature, which allows the occurrence of a wrinkle to be further suppressed.

Meanwhile, the invention is not limited to the above-described first, second, and third exemplary embodiments and the first modification example.

Second Modification Example

Figure 17:
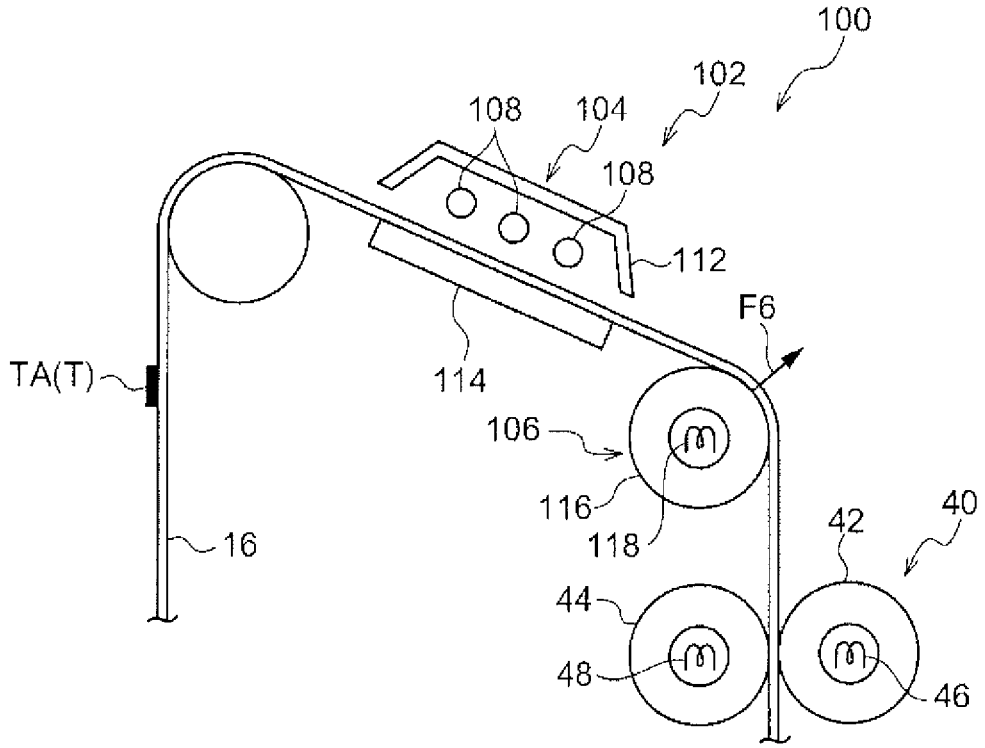
FIG. 17 is a configuration diagram of a fixing device according to a second modification example.

FIG. 17 shows a fixing device 100 as a second modification example of the exemplary embodiment. The fixing device 100 includes a preprocessing unit 102 and a fixing unit 40. The preprocessing unit 102 includes a first heating unit 104 and a second heating unit 106.

The first heating unit 104 is provided at the upstream side with respect to the fixing unit 40 in a transport direction of a film 16. In addition, the first heating unit 104 includes three carbon heaters 108, a cover 112 that covers the three carbon heaters 108, and a reflection plate 114 that faces the three carbon heaters 108 with the film 16 interposed therebetween, as an example. The three carbon heaters 108 are disposed on the surface side of the film 16 where a toner image TA is formed, so as not to be in contact with the film 16. In addition, the three carbon heaters 108 heat the film 16 so that the temperature of the film 16 is set to be equal to or higher than the above-mentioned first temperature T1 (as an example, 120° C.). the reflection plate 114 is disposed on the rear surface side that is opposite to the front side of the film 16, and comes into contact with the rear surface of the film 16.

The second heating unit 106 is provided at the downstream side with respect to the first heating unit 104 and at the upstream side with respect to the fixing unit 40 in a transport direction of the film 16. In addition, the second heating unit 106 includes a second heating roller 116 and a heater 118. The second heating roller 116 is a cylindrical metal roller and is rotatably provided. The film 16 is wound around a portion of the outer circumferential surface of the second heating roller 116. The second heating roller 116 comes into contact with the rear surface of the film 16. The heater 118 is disposed inside the second heating roller 116, and heats the second heating roller 116 at a second temperature T2 (as an example, 80° C.), which is lower than the above-mentioned first temperature T1.

In the fixing device 100, the film 16 that is heated by the first heating unit 104 receives a vertical drag F6 from the second heating roller 116 in the second heating unit 106. Further, the film 16 is heated at the second temperature T2 lower than a thermal deformation temperature by coming into contact with the second heating roller 116, and thus a sudden temperature drop from the first temperature T1 is suppressed. By these effects, in the fixing device 100, a wrinkle is not likely to be fixed as compared to a configuration in which the film 16 is naturally cooled between the first heating unit 104 and the fixing unit 40, and thus the occurrence of a wrinkle on the film 16 transported from the first heating unit 104 to the fixing unit 40 is suppressed. In this manner, the first heating unit 104 may be a non-contact type that does not come into contact with the film 16.

Other Modification Examples

In the fixing device 90, each of the second heating rollers 76 and 78 may be replaced with one second heating roller (for example, a second heating roller 37).

The first heating roller 33, second heating rollers 37, 76, and 77, and the intermediate roller 96 are not limited to being formed of aluminum, and may be formed of other metals (for example, stainless steel). In addition, the outer circumferential surface of each of the first heating roller 33, the second heating rollers 37, 76, and 77, and the intermediate roller 96 may be formed of a material having low surface energy so that a toner image TA is not likely to be attached thereto. For example, the outer circumferential surface may be formed of a tetrafluoroethylene-perfluoroalkylvinylether copolymer (PFA) or polytetrafluoroethylene (PTFE) which is a fluorine-based resin. Further, it is preferable that the first heating roller 33, the second heating rollers 37, 76, and 77, and the intermediate roller 96 are rotated by driving.

A toner T is not limited to a polyester resin, and may be other resins. In addition, a developer used in the image forming apparatus 10 is not limited to a liquid developer G, and may be a dry developer that does not contain oil.

The fixing unit 40 is not limited to a roller type using a fixing roller 42 and a pressing roller 44, and may be a belt type. In addition, the fixing unit 40 is not limited to a unit using the set of the fixing roller 42 and the pressing roller 44, and may use two or more sets of rollers.

The temperature of the first heating roller 33 may be set to other temperatures in a range between 110° C. or higher and 120° C. or lower. The temperature of each of the second heating rollers 37, 76, and 77 may be set to other temperatures in a temperature range between 80° C. or higher and a first temperature T1 or lower. The temperature of the intermediate roller 96 is not limited to 100° C., and may be set to other temperatures in a temperature range between the first temperature T1 or lower and a second temperature T2 or higher. A thermal deformation temperature is not limited to 110° C., and may be other temperatures.

Fourth Exemplary Embodiment

Next, examples of a fixing device and an image forming apparatus according to a fourth exemplary embodiment will be described. Meanwhile, members and portions that are basically the same as those in the first exemplary embodiment described above will be denoted by the same reference numerals and signs as those in the first exemplary embodiment, and a description thereof will not be repeated.

Figure 18:
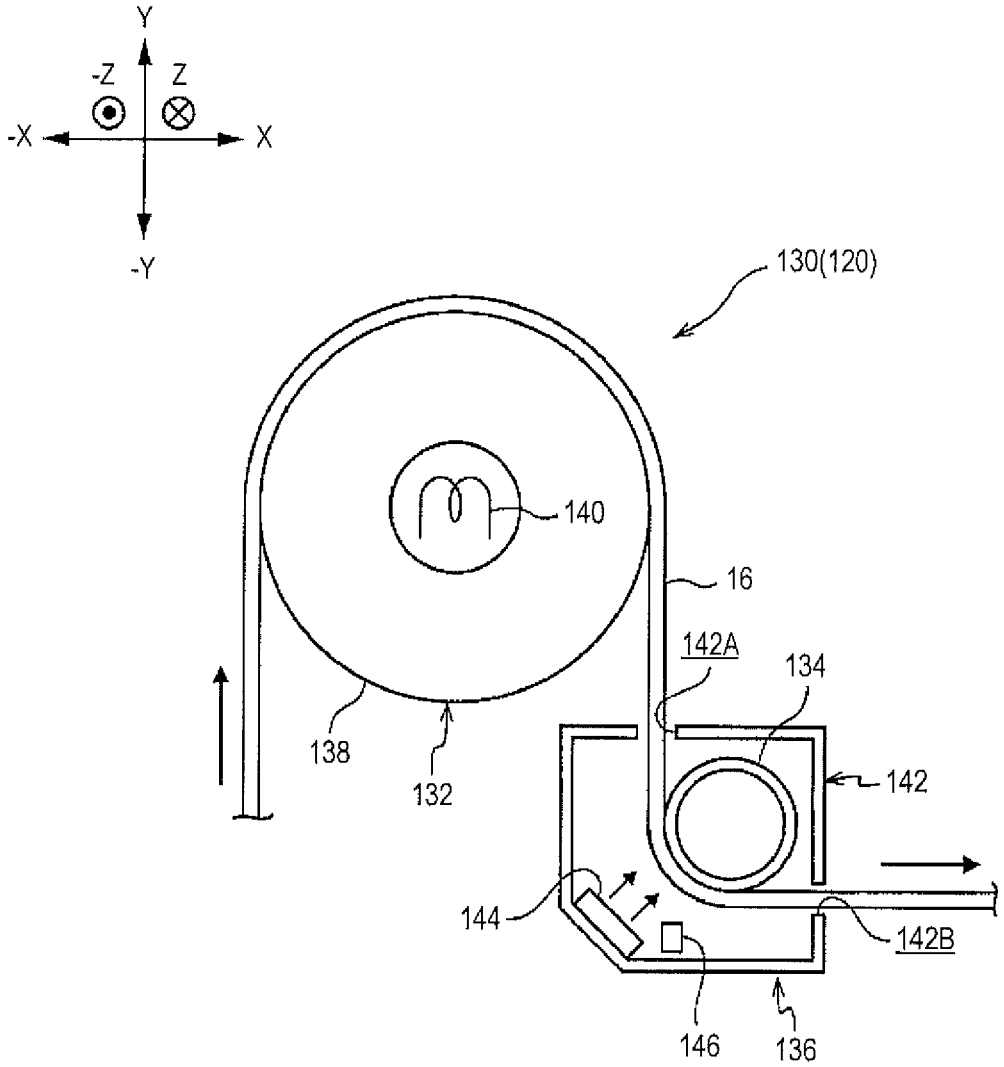
FIG. 18 is a diagram showing main components (preprocessing unit) of the image forming apparatus according to a fourth exemplary embodiment.

FIG. 18 shows a fixing device 120 according to the fourth exemplary embodiment. The fixing device 120 is provided instead of the fixing device 20 (see FIG. 1) in the image forming apparatus 10 (see FIG. 1) of the first exemplary embodiment. In addition, the fixing device 120 includes a preprocessing unit 130 and a fixing unit 40 (see FIG. 1).

As shown in FIG. 18, the preprocessing unit 130 includes a heating unit 132, an expander roller 134 as an example of a pulling unit, and a temperature control unit 136 as an example of a temperature control unit that controls a temperature at a fifth temperature.

The heating unit 132 is disposed at the upstream side with respect to the fixing unit 40 (see FIG. 1) in a transport direction of a film 16. In addition, the heating unit 132 includes a heating roller 138 and a heater 140, as an example. In addition, the heating unit 132 heats the film 16 so that the temperature of the film 16 is set at a fourth temperature T4 (not shown). The fourth temperature T4 is a temperature that is equal to or higher than a thermal deformation temperature of the film 16 to be described later, and is set to 100° C. as an example in this exemplary embodiment.

The heating roller 138 is constituted by an aluminum cylindrical metal roller as an example, and is provided rotatably around the Z-direction as the axial direction. In addition, the heating roller 138 is configured such that the outer circumferential surface thereof in a range equivalent to a semicircle on the Y side comes into contact with the film 16 when seen in the Z-direction, as an example. In other words, the film 16 is wound around a region of substantially half the outer circumferential surface of the heating roller 138 in a circumferential direction.

The heater 140 is disposed inside the heating roller 138. In addition, the heater 140 is configured such that the heating temperature thereof is controlled by a temperature sensor not shown in the drawing and the control unit 18 (see FIG. 1), and heats the heating roller 138 so that the temperature of the film 16 coming into contact with the heating roller 138 is set at the fourth temperature T4.

The expander roller 134 is disposed between the heating unit 132 and the fixing unit 40 in a transport direction of the film 16. The expander roller 134 is provided rotatably around the Z-direction as the axial direction. In addition, the expander roller 134 is configured such that the film 16 is wound around the outer circumferential surface thereof, and is configured to pull the wound film 16 in the width direction of the film 16 to expand the film 16 in the width direction. Meanwhile, a rubber expander roller of which the outer circumferential portion is covered with rubber is used as the expander roller 134 of this exemplary embodiment, as an example.

A temperature control unit 136 is a unit that controls the temperature of the film 16 pulled in the width direction by the expander roller 134 at a fifth temperature T5 that is lower than the thermal deformation temperature. The temperature control unit 136 includes a housing 142 and a fan 144.

The housing 142 accommodates the expander roller 134 therein with the Z-direction as the longitudinal direction. A bearing portion, not shown in the drawing, that rotatably supports the expander roller 134 is provided at both ends of the housing 142 in the longitudinal direction. In addition, the housing 142 is provided with an input port 142A of the film 16 on the upstream side thereof in a transport direction of the film 16, and is provided with an output port 142B of the film 16 on the downstream side thereof.

The fan 144 is disposed inside the housing 142. The temperature of the film 16 is controlled by gas (as an example, air in this exemplary embodiment) that is supplied from the fan 144. Specifically, the fan 144 is installed in the housing 142 in a direction in which gas can be supplied to an outer surface of a portion which is wound around the expander roller 134 of the film 16 and is pulled in the width direction. Meanwhile, the invention is not limited to the above-described configuration, and an installation position of the fan 144 within the housing 142 and a gas supply direction may be appropriately adjusted.

In addition, a temperature sensor 146 that measures the temperature of a portion of the film 16, which is wound around the expander roller 134 and is pulled in the width direction, is disposed within the housing 142. The fan 144 supplies gas to the film 16 so that the amount of gas is adjusted by the control unit 18 (see FIG. 1) on the basis of a temperature measured by the temperature measured by the temperature sensor 146 and the temperature of a portion of the film 16, which is wound around the expander roller 134 and is pulled in the width direction, is set at the fifth temperature T5.

Meanwhile, it is preferable that the fifth temperature T5 of this exemplary embodiment is set to a temperature that is lower than the thermal deformation temperature of the film 16 and is capable of slightly deforming the film 16. Meanwhile, the fifth temperature T5 in this exemplary embodiment is set at 60° C., as an example.

Next, effects of the fourth exemplary embodiment will be described.

As shown in FIG. 1, in the image forming apparatus 10, a toner image TA is formed on the film 16 transported, by an image forming unit 12. The toner image TA on the film 16 is preprocessed (heated) by a preprocessing unit 130 of the fixing device 120 (see FIG. 18) and is then heated and processed by the fixing unit 40, to thereby be fixed on the film 16.

Here, in the fixing device 120, the film 16 heated by the heating unit 132 is pulled and expanded in the width direction by the expander roller 34, and the portion of the film 16 pulled in the width direction of the film 16 is controlled at the fifth temperature T5, which is less than the thermal deformation temperature, by being cooled by the gas supplied by the fan 144 of the temperature control unit 136. In this manner, since the portion of the film 16 that is pulled in the width direction and that has a wrinkle expanded, is cooled by the fan 144, a wrinkle is not likely to occur again on the film 16. In this state, since the film 16 is transported to the fixing unit 40, and thus it is possible to prevent a wrinkle from occurring again on the film 16 transported to the fixing unit 40, as compared to a configuration in which the temperature of the film 16 (pulled portion of the film 16) is not controlled during pulling.

In particular, in this exemplary embodiment, the fifth temperature T5 is set at a temperature at which the film 16 can be slightly thermally deformed, and thus it is possible to effectively perform wrinkle-removing (wrinkle smoothing) of the film 16.

In addition, in the image forming apparatus 10, a wrinkle is prevented from occurring again on the film 16 in the fixing device 120, and thus an image defect (for example, partial peeling-off of the toner image TA) that is caused by the wrinkle of the film 16 is suppressed when the toner image TA is fixed on the film 16.

Next, a thermal deformation temperature of the film 16 will be described. Meanwhile, "thermal deformation" refers to plastic deformation (permanent deformation) of the film 16 from which heat is radiated.

First, the outline of a thermal deformation test apparatus will be described.

Figure 19A:
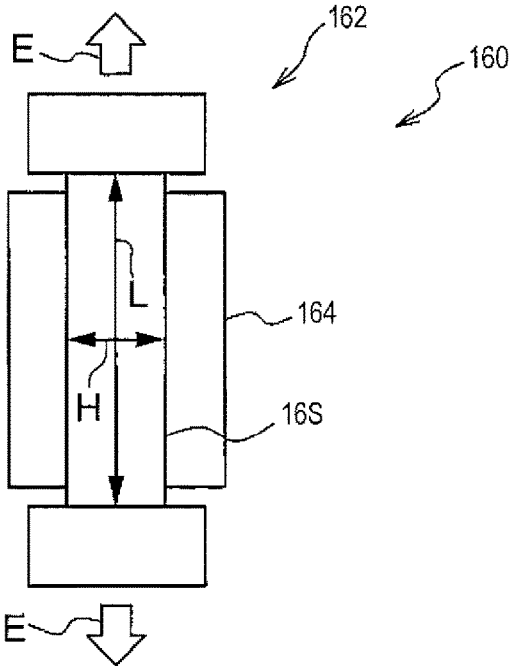
FIG. 19A is a schematic configuration diagram of a test apparatus that measures the thermal deformation of a film.

A thermal deformation test apparatus 160 shown in FIG. 19A includes a tensile force unit 162 that pulls a sample 16S of the film 16 as indicated by an arrow E and a heating unit 164 that heats the sample 16S. Meanwhile, the tensile force unit 162 can pull the sample 16S and can measure a tensile force applied to the sample 16S. In addition, the sample 16S of the film 16 is configured such that a width H is set to 15 mm and a length L is set to 75 mm. In addition, in this exemplary embodiment, the tensile force unit 162 can perform a pulling test based on JIS-K-7127:1999. In this test, a tester FGS-TV manufactured by Nidec-Shimpo Corporation is used.

Next, a thermal deformation test method will be described.

Figure 19B:
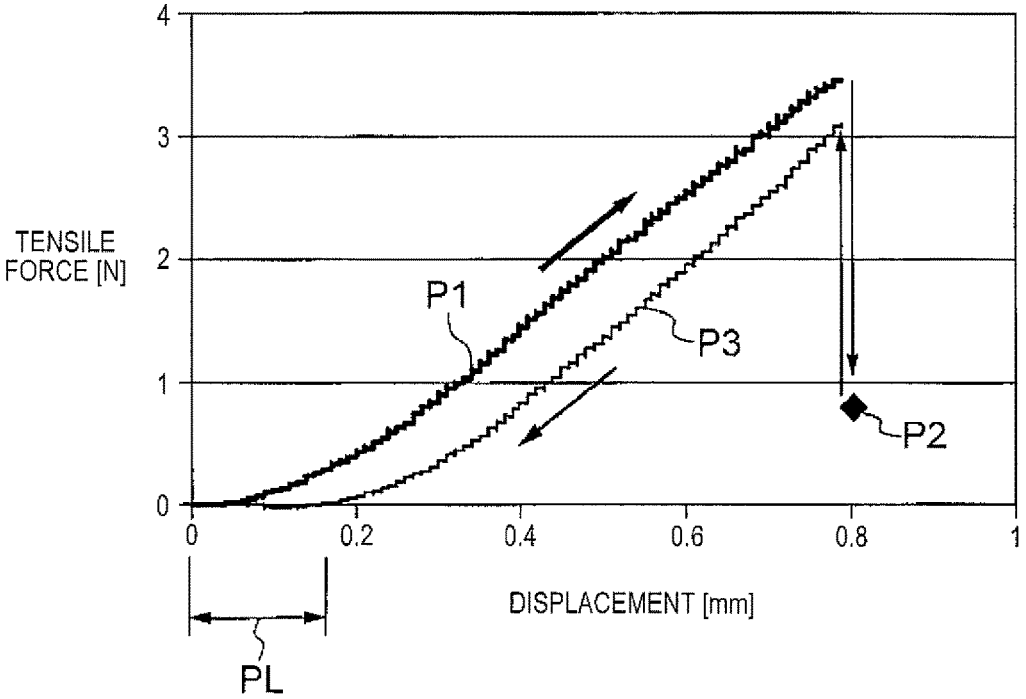
FIG. 19B is a graph showing test results.

First, the sample 16S is pulled at room temperature (25° C.) by 2 mm per minute, and is stopped being pulled when being set to be a predetermined displacement. In addition, a tensile force of the sample 16S is measured. Meanwhile, a relationship between the displacement and the tensile force is indicated by P1 in a graph of FIG. 19B.

The heating unit 164 is brought into contact with the sample 16S for a fixed period of time. This period of time is set to be a heating time within the actual image forming apparatus 10. For example, in the image forming apparatus 10 of this example, the heating unit is brought into contact with the sample for two seconds, which is a maximum time when the toner image TA passes through the fixing unit. The sample 16S expands by heating, and a tensile force is lowered. At this time, the lowered tensile force is indicated by P2 in the graph of FIG. 19B.

After heating is stopped, the sample 16S contracts by cooling (returning) to room temperature (25° C.), and a tensile force is increased. In addition, the displacement of the sample 16S is returned to its original state to thereby obtain the amount of displacement PL (FIG. 19B) in which a tensile force is set to 0 (zero).

In addition, the amount of displacement PL is the amount of expansion and contraction obtained by the thermal deformation of the sample 16S, and a value obtained by dividing the sample 16S by the original length L (=75 mm) of the sample is an expansion and contraction rate.

Figure 20:
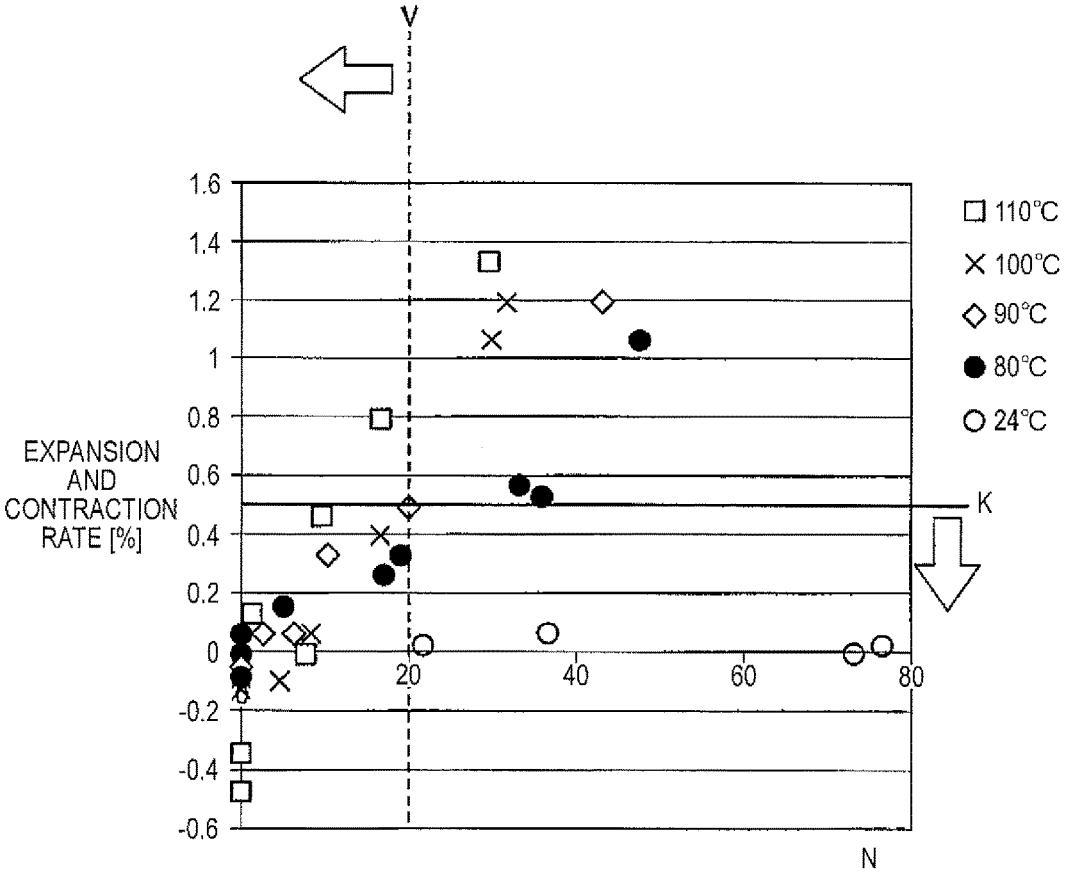
FIG. 20 is a graph in which measurement results of the thermal deformation of a film are gathered.

A graph shown in FIG. 20 shows results gathered by performing the above-mentioned test by changing the heating temperature of the sample 16S, the results being obtained by the conversion of a tensile force acting on the sample 16S into a length (500 mm in this example) of the film 16 to which the tensile force is applied in the image forming apparatus 10. Meanwhile, FIG. 20 shows measurement results of an OPP film having a thickness of 20 μm, as an example.

Here, a reference value (target value) K of an expansion and contraction rate obtained by the expansion and contraction rate of the film 16 in the image forming apparatus 10 of this exemplary embodiment and a maximum value V of a tensile force applied to the film 16 during heating transportation are measured or calculated. Meanwhile, in the image forming apparatus 10, the thermal deformation (expansion and contraction) of the film 16 results in a degradation of image quality such as the generation of a wrinkle, and an expansion and contraction rate that is allowable for the degradation of image quality is the reference value (target value) K. Meanwhile, the reference value K may be appropriately determined in accordance with the type of image to be formed, postprocessing such as laminating or cutting-off, and the use and size of a film having an image formed thereon. In the following exemplary embodiment, a description will be given by setting a reference value K to 0.5%.

In addition, from the graph shown in FIG. 20, a heating temperature that is set to be equal to or less than the reference value K of the expansion and contraction rate of the film 16 in the maximum value V of the tensile force applied during heating transportation in the image forming apparatus 10 is a "thermal deformation temperature of the film 16". Meanwhile, in this exemplary embodiment, the maximum value V of a tensile force applied during heating transportation is 20 N (with respect to a length of 500 mm) and the reference value K of the expansion and contraction rate is 0.5%, and thus the thermal deformation temperature of the film 16 is set to 100° C. from the graph.

Fifth Exemplary Embodiment

Next, a fixing device according to a fifth exemplary embodiment of the invention will be described with reference to the accompanying drawings. Meanwhile, the same components as those in the fourth exemplary embodiment will be denoted by the same reference numerals and signs, and a description thereof will not be repeated.

Figure 21:
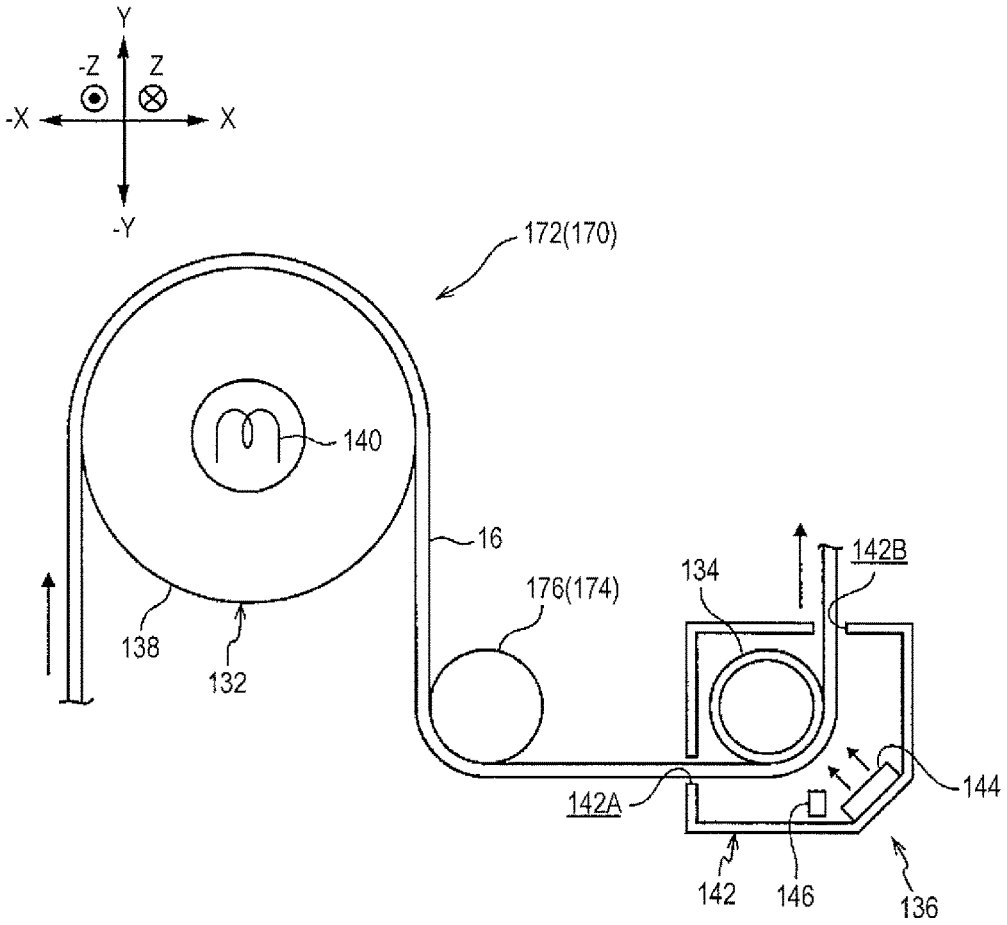
FIG. 21 is a diagram showing main components (preprocessing unit) of a fifth exemplary embodiment.

As shown in FIG. 21, a preprocessing unit 172 of a fixing device 170 of this exemplary embodiment has the same configurations as those of the fixing device 120 of the fourth exemplary embodiment, except for a configuration in which a temperature control unit 174 as an example of a temperature control unit that controls a film 16 at a sixth temperature T6 is further provided between a heating unit 132 and an expander roller 134 in a transport direction of the film 16.

The temperature control unit 174 includes a temperature adjustment roller 176. The temperature adjustment roller 176 is provided rotatably around the Z-direction as the axial direction, and is configured such that the film 16 is wound around the outer circumferential surface thereof. The temperature adjustment roller 176 controls the film 16 wound around the outer circumferential surface thereof at a sixth temperature T6 (as an example, 100° C. in this exemplary embodiment) between the fourth temperature T4 and the fifth temperature T5. Specifically, the temperature adjustment roller 176 is provided with a flow channel, not shown in the drawing, through which a heat medium is able to move, and is configured to be able to control the temperature of the film 16 wound around the outer circumferential surface thereof in accordance with the temperature of the heat medium.

In addition, the temperature control unit 174 controls the temperature of the temperature adjustment roller 176, and thus includes a temperature sensor, not shown in the drawing, that measures the temperature of the film 16 wound around the temperature adjustment roller 176. The heat medium flowing through the temperature adjustment roller 176 is configured such that the temperature thereof is controlled by the control unit 18 (see FIG. 1) on the basis of a temperature measured by a temperature sensor and is transported to the inside of the temperature adjustment roller 176 so that the temperature of a portion wound around the temperature adjustment roller 176 of the film 16 is set at the sixth temperature T6.

Next, effects according to this exemplary embodiment will be described. Meanwhile, a description of an effect obtained by the same configuration as that of the fixing device 120 according to the fourth exemplary embodiment will not be repeated.

In the fixing device 170, the temperature of the film 16 is controlled to the sixth temperature T6 while the film 16 is transported from the heating unit 132 to the expander roller 134, and thus the temperature gradient when the film is transported to the expander roller 134 is smaller than that in a configuration in which the temperature of the film is not controlled to the sixth temperature T6, thereby preventing a wrinkle from occurring on the film 16 again.

Sixth Exemplary Embodiment

Next, a fixing device according to a sixth exemplary embodiment of the invention will be described with reference to the accompanying drawings. Meanwhile, the same components as those in the fourth exemplary embodiment will be denoted by the same reference numerals and signs, and a description thereof will not be repeated.

Figure 22:
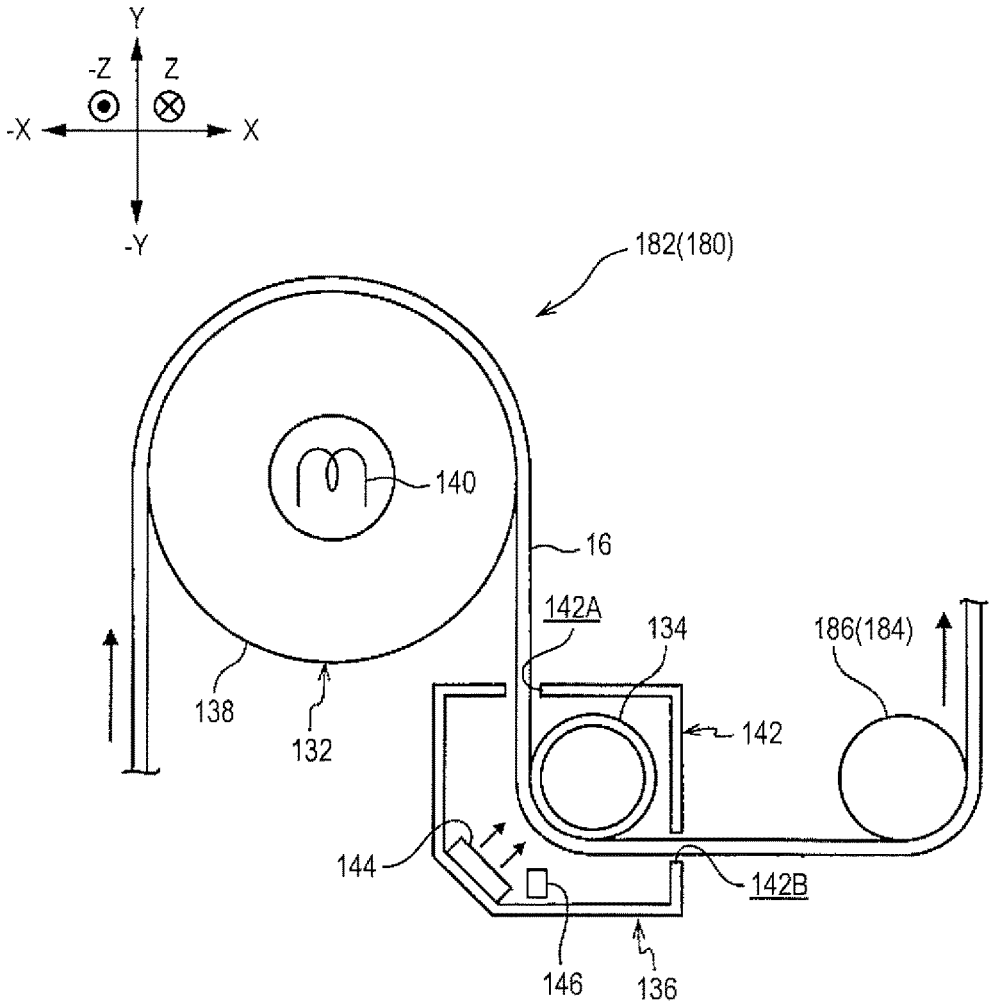
FIG. 22 is a diagram showing main components (preprocessing unit) of a sixth exemplary embodiment.

As shown in FIG. 22, a preprocessing unit 182 of a fixing device 180 of this exemplary embodiment has the same configurations as those of the fixing device 120 of the fourth exemplary embodiment, except for a configuration in which a temperature control unit 184 as an example of a temperature control unit that controls a film 16 at a seventh temperature T7 is provided between the expander roller 134 and the fixing unit 40 in a transport direction of the film 16.

The temperature control unit 184 includes a temperature adjustment roller 186. The temperature adjustment roller 186 is provided rotatably around the Z-direction as the axial direction and is configured such that the film 16 is wound around the outer circumferential surface thereof. The temperature adjustment roller 186 controls the film 16 wound around the outer circumferential surface thereof at the seventh temperature T7 (as an example, 40° C. in this exemplary embodiment), which is lower than the fifth temperature T5. Specifically, the temperature adjustment roller 186 is provided with a flow channel, not shown in the drawing, through which a heat medium is able to move, and is configured to be able to control the temperature of the film 16 wound around the outer circumferential surface thereof in accordance with the temperature of the heat medium.

In addition, the temperature control unit 184 controls the temperature of the temperature adjustment roller 186, and thus includes a temperature sensor, not shown in the drawing, that measures the temperature of the film 16 wound around the temperature adjustment roller 186. The heat medium flowing through the temperature adjustment roller 186 is configured such that the temperature thereof is controlled by the control unit 18 (see FIG. 1) on the basis of a temperature measured by a temperature sensor and is transported to the inside of the temperature adjustment roller 186 so that the temperature of a portion wound around the temperature adjustment roller 186 of the film 16 is set at the seventh temperature T7.

Next, effects according to this exemplary embodiment will be described. Meanwhile, a description of an effect obtained by the same configuration as that of the fixing device 120 according to the fourth exemplary embodiment will not be repeated.

In the fixing device 180, the temperature of the film 16 is controlled at the seventh temperature T7 while the film 16 is transported from the expander roller 134 to the fixing unit 40, and thus the film 16 is less likely to be deformed in the width direction than in a configuration in which the temperature of the film is not controlled to the seventh temperature T7, thereby preventing a wrinkle from occurring on the film 16 again.

Meanwhile, the configuration of the fixing device 170 of the fifth exemplary embodiment may be applied to the fixing device 180 of the sixth exemplary embodiment. Specifically, the temperature control unit 174 may be provided between the heating unit 132 and the expander roller 134 of the fixing device 180. In a case where this configuration is adopted, it is possible to further prevent a wrinkle from occurring on the film 16 transported to the fixing unit 40.

Seventh Exemplary Embodiment

Next, a fixing device according to a seventh exemplary embodiment of the invention will be described with reference to the accompanying drawings. Meanwhile, the same components as those in the fourth exemplary embodiment will be denoted by the same reference numerals and signs, and a description thereof will not be repeated.

Figure 23:
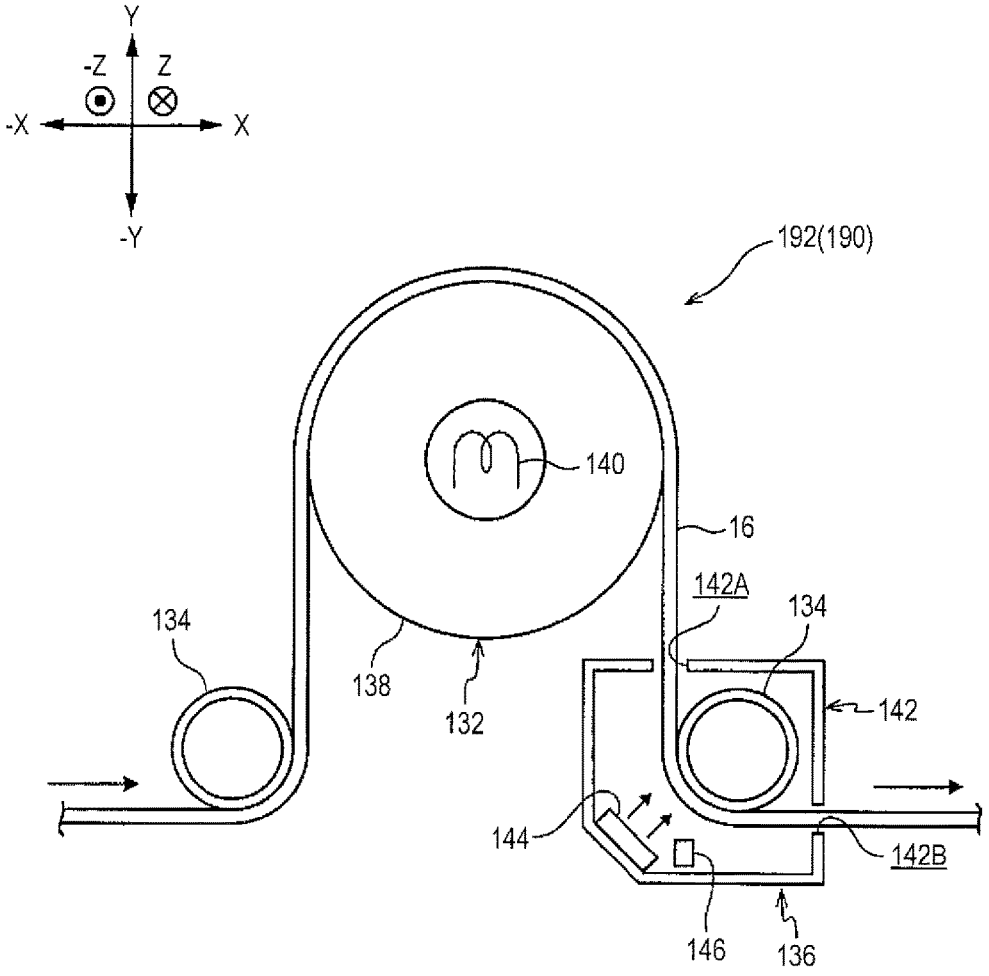
FIG. 23 is a diagram showing main components (preprocessing unit) of a seventh exemplary embodiment.

As shown in FIG. 23, a preprocessing unit 192 of a fixing device 190 of this exemplary embodiment has the same configurations as those of the fixing device 120 of the fourth exemplary embodiment, except for a configuration in which an expander roller 134 is further provided at the upstream side with respect to the heating unit 132 in a transport direction of the film 16.

Next, effects according to this exemplary embodiment will be described. Meanwhile, a description of an effect obtained by the same configuration as that of the fixing device 120 according to the fourth exemplary embodiment will not be repeated.

In the fixing device 190, the expander roller 134 is also provided at the upstream side with respect to the heating unit 132 in the transport direction of the film 16, and thus the film 16 is pulled in the width direction before being transported to the heating unit 132. For this reason, it is possible to prevent a wrinkle from occurring again on the film 16 transported to the fixing unit 40, as compared to a configuration in which the expander roller 134 is not provided at the upstream side with respect to the heating unit 132 in the transport direction of the film 16.

Meanwhile, the configuration of the seventh exemplary embodiment, that is, a configuration in which the expander roller 134 is also provided at the upstream side with respect to the heating unit 132 in the transport direction of the film 16 may be applied to the above-described fourth to sixth exemplary embodiments.

In addition, in the fourth to seventh exemplary embodiments, an expander roller is used as an example of a pulling unit that pulls the film 16 in the width direction, but the invention is not limited to this configuration. A concave roller, a helical roller, a micro groove roller, or an end nip roller may be used as an example of the pulling unit.

In the temperature control unit 136 of the fourth exemplary embodiment, temperature is controlled by cooling the portion of the film 16 that is wound around the expander roller 134 and is pulled in the width direction, using the fan 144. However, the invention is not limited to this configuration, and a configuration may be adopted in which temperature is controlled to the fifth temperature T5 using a heater that performs heating at the fifth temperature T5, which is lower than the fourth temperature T4.

In addition, in the temperature control unit 136 of the fourth exemplary embodiment, temperature is controlled by cooling a portion of the film 16 that is wound around the expander roller 134 and is pulled in the width direction, using the fan 144. However, the temperature of a portion of the film 16 that is wound around the expander roller 134 may be controlled by making a heat medium flow into the expander roller 134.

Experimental Example

Next, the following experiments were performed using the fixing device of the fourth, fifth, sixth, and seventh exemplary embodiment in order to confirm effects in the invention.

Experiment 1

First, a fixing device according to Example 1 that has the same structure as that in the fourth exemplary embodiment was prepared, and a reoccurrence of a wrinkle on a film sample was visually confirmed with the fourth temperature T4 varied from 100° C. to 120° C. by 10° C. each time in a state where a fifth temperature T5 was set at 60° C. Similarly, a reoccurrence of a wrinkle on a sample was visually confirmed with the fourth temperature T4 varied from 100° C. to 120° C. by 10° C. each time in a state where the fifth temperature T5 was set at 80° C., 90° C. and 100° C. Meanwhile, a thermal deformation temperature of the sample used in this experiment was 100° C. In addition, results of the visual confirmation were evaluated on the assumption that "A" is best, "B" is good, and "C" is acceptable.

TABLE 1

| | | Fourth Temperature T4 (° C.) | | |
|---|---|---|---|---|
| | | 100 | 110 | 120 |
| Fifth Temperature T5 (° C.) | 100 | C | C | C |
| | 90 | B | B | C |
| | 80 | A | B | B |
| | 60 | A | B | B |

As shown in Table 1, in a case where the fifth temperature T5 is a thermal deformation temperature of the sample, it could be understood that it was not likely to suppress the reoccurrence of a wrinkle. Therefore, in the fixing device of Example 1, when the fourth temperature T4 is set within a range from 100° C. to 120° C., it can be understood that it is preferable to set the fifth temperature T5 within a range from 60° C. to 90° C.

Experiment 2

Next, a fixing device of Example 2 which has the same structure as that in the fifth exemplary embodiment according to the invention was prepared, and a reoccurrence of a wrinkle on a film sample was visually confirmed with the fifth temperature T5 varied at 25° C., 60° C., 80° C., 90° C., and 100° C. in a state where the fourth temperature T4 was set at 120° C. with or without the control at the sixth temperature T6 of 100° C. performed. Meanwhile, a thermal deformation temperature of the sample used in this experiment was 100° C. In addition, results of the visual confirmation were judged "A" as best, "B" as good, or "C" as acceptable.

TABLE 2

| | | Control at Sixth Temperature T6 | |
|---|---|---|---|
| | | is not performed | is performed |
| Fifth Temperature T5 (° C.) | 100 | C | C |
| | 90 | B | B |
| | 80 | B | A |
| | 60 | B | A |

As shown in Table 2, the reoccurrence of a wrinkle on a sample in a case where control at the sixth temperature T6 is performed is greatly different from that in a case where control at the sixth temperature is not performed. Specifically, it can be understood that effects by control at the sixth temperature T6 are obtained as a temperature gradient of the sample between the heating unit and the expander roller increases.

Experiment 3

Next, a fixing device of Example 3 which has the same structure as that in the sixth exemplary embodiment according to the invention was prepared, and a reoccurrence of a wrinkle on a film sample was visually confirmed with the fifth temperature T5 varied at 60° C., 80° C., 90° C., and 100° C. in a state where the fourth temperature T4 was set at 120° C. with or without the control at the seventh temperature T7 of 40° C. performed. Meanwhile, a thermal deformation temperature of the sample used in this experiment was 100° C. In addition, results of the visual confirmation were judged "A" as best, "B" as good, and "C" as acceptable.

TABLE 3

| | | Control at Seventh Temperature T7 | |
|---|---|---|---|
| | | Is not performed | Is performed |
| Fifth Temperature T5 (° C.) | 100 | C | C |
| | 90 | C | B |
| | 80 | B | A |
| | 60 | B | A |

As shown in Table 3, a reoccurrence of a wrinkle on a sample in a case where control at the seventh temperature T7 is performed is greatly different from that in a case where control at the Seventh temperature T7 is not performed. Specifically, it can be understood that there is a tendency for a wrinkle to occurring again as a temperature gradient of the sample between the expander roller and the fixing unit increases.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing unit that comprises a fixing member heating a developer on a thermoplastic recording medium that is transported in a state where a tensile force is applied to the recording medium, and fixes the heated developer on the recording medium;

a first heating unit that is disposed at an upstream side with respect to the fixing unit in a transport direction of the recording medium, and heats the recording medium so that a temperature of the recording medium is set at a first temperature that is equal to or lower than a temperature of the fixing member and is equal to or higher than a thermal deformation temperature at which the recording medium is deformed; and at least one second heating unit that comes into contact with the recording medium at a downstream side with respect to the first heating unit and at an upstream side with respect to the fixing unit, and heats the recording medium at a second temperature that is lower than the first temperature.

2. The fixing device according to claim 1, wherein the first heating unit comes into contact with the recording medium.

3. The fixing device according to claim 1, wherein the at least one second heating unit comprises a single second heating unit.

4. The fixing device according to claim 1, further comprising a third heating unit that is disposed at a downstream side with respect to the first heating unit and at an upstream side with respect to the second heating unit, comes into contact with the recording medium and heats the recording medium at a third temperature that is lower than the first temperature and higher than the second temperature.

5. An image forming apparatus comprising:

a developer image forming unit that forms a developer image on a thermoplastic recording medium; and the fixing device according to claim 1 that heats the developer image and fixes the heated developer image on the recording medium.

6. A fixing device comprising:

a fixing unit that heats a developer on a thermoplastic recording medium and fixes the heated developer on the recording medium;

a heating unit that is disposed at an upstream side with respect to the fixing unit in a transport direction of the recording medium and heats the recording medium so that a temperature of the recording medium is set at a temperature T4 that is equal to or higher than a thermal deformation temperature at which the recording medium is deformed;

a pulling unit that is disposed between the heating unit and the fixing unit in the transport direction of the recording medium and pulls the recording medium in a width direction of the recording medium; and a temperature control unit that controls the temperature of the recording medium that is being pulled by the pulling unit, at a temperature T5 that is lower than the thermal deformation temperature.

7. The fixing device according to claim 6, further comprising:

a temperature control unit that is disposed between the heating unit and the pulling unit, and controls the temperature of the recording medium at a temperature T6 that is between the temperature T4 and the fifth temperature T5.

8. The fixing device according to claim 6, further comprising:

a temperature control unit that is disposed between the pulling unit and the fixing unit, and controls the temperature of the recording medium at a temperature T7 that is lower than the temperature T5.

9. An image forming apparatus comprising:

a developer image forming unit that forms a developer image on a thermoplastic recording medium; and the fixing device according to claim 6 that heats the developer image and fixes the heated developer image on the recording medium.

* * * * *